US005459005A

United States Patent [19]

Kato et al.

[11] Patent Number: 5,459,005

[45] Date of Patent: Oct. 17, 1995

[54] ELECTROPHOTOGRAPHIC LIGHT-SENSITIVE MATERIAL

[75] Inventors: Eiichi Kato; Kazuo Ishii, both of Shizuoka, Japan

[73] Assignee: Fuji Photo Film Co., Ltd., Kanagawa, Japan

[21] Appl. No.: 193,071

[22] PCT Filed: Jun. 3, 1993

[86] PCT No.: PCT/JP93/00748

§ 371 Date: Feb. 3, 1994

§ 102(e) Date: Feb. 3, 1994

[87] PCT Pub. No.: WO93/24864

PCT Pub. Date: Dec. 9, 1993

[30] Foreign Application Priority Data

| | | | |
|---|---|---|---|
| Jun. 3, 1992 | [JP] | Japan | 4-166755 |
| Feb. 25, 1993 | [JP] | Japan | 5-059307 |
| Feb. 25, 1993 | [JP] | Japan | 5-059309 |
| Mar. 16, 1993 | [JP] | Japan | 5-080256 |
| Apr. 2, 1993 | [JP] | Japan | 5-098301 |

[51] Int. Cl.[6] ..... G03G 5/087

[52] U.S. Cl. ..... 430/95; 430/49; 430/90; 430/93; 430/96

[58] Field of Search ..... 430/49, 90, 93, 430/95, 96

[56] References Cited

U.S. PATENT DOCUMENTS 5,252,419 10/1993 Kato et al. ..... 430/96

FOREIGN PATENT DOCUMENTS

| | | |
|---|---|---|
| 125266 | 5/1990 | Japan . |
| 127651 | 5/1990 | Japan . |
| 135457 | 5/1990 | Japan . |
| 167551 | 6/1990 | Japan . |
| 2870 | 1/1991 | Japan . |
| 13951 | 1/1991 | Japan . |
| 17664 | 1/1991 | Japan . |
| 42666 | 2/1991 | Japan . |
| 42665 | 2/1991 | Japan . |
| 39967 | 2/1991 | Japan . |
| 29954 | 2/1991 | Japan . |
| 46665 | 2/1991 | Japan . |

*Primary Examiner*—Roland Martin

*Attorney, Agent, or Firm*—Sughrue, Mion, Zinn, Macpeak & Seas

[57] ABSTRACT

An electrophotographic light-sensitive material which is excellent in image reproducibility, moisture resistance and anti-abrasion property, provides clear images of good quality and is particularly useful in a scanning exposure system using a semiconductor laser beam is provided.

The electrophotographic light-sensitive material contains, as a binder resin, a resin (A) which has an acid value of from 5 to 120 and contains a component of the formula (I) shown below and a specified polar group-containing component and a resin (B) which is an AB or ABA block copolymer comprising an A block containing a component of the formula (II) shown below and a B block containing a component derived from a specific macromonomer having a specified polar group.

In the formulae (I) and (II) below, $a^1$ and $a^2$ each represents a hydrogen atom, a halogen atom, a cyano group, a hydrocarbon group, —$COOR^4$ or —$COOR^4$ bonded via a hydrocarbon group ($R^4$ represents a hydrocarbon group); and $R^{11}$ and $R^{12}$ each represents a hydrocarbon group.

Formula (I)

Formula (II)

6 Claims, No Drawings

ELECTROPHOTOGRAPHIC LIGHT-SENSITIVE MATERIAL

TECHNICAL FIELD

The present invention relates to an electrophotographic light-sensitive material, and more particularly to an electrophotographic light-sensitive material which is excellent in image reproducibility, moisture resistance and anti-abrasion property.

TECHNICAL BACKGROUND

An electrophotographic light-sensitive material may have various structures depending upon the characteristics required or an electrophotographic process to be employed.

Typical electrophotographic light-sensitive materials widely employed comprise a support having provided thereon one photoconductive layer and an insulating layer on the surface thereof.

The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing in the order of from several hundreds to several thousands prints having a high image quality.

Under these circumstances, binder resins which are used for forming the photoconductive layer of an electrophotographic light-sensitive material are required to be excellent in the film-forming properties by themselves and the capability of dispersing photoconductive powder therein. Also, the photoconductive layer formed using the binder resin is required to have satisfactory adhesion to a base material or support. Further, the photoconductive layer formed by using the binder resin is required to have various excellent electrostatic characteristics such as high charging capacity, small dark decay, large light decay, and less fatigue due to prior light-exposure and also have an excellent image forming properties, and the photoconductive layer stably maintains these electrostatic properties in spite of the fluctuation in humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

It has been found that the chemical structure of binder resin used in a photoconductive layer which contains at least an inorganic photoconductive substance, a spectral sensitizing dye and a binder resin has a great influence upon the electrostatic characteristics as well as smoothness of the photoconductive layer. Among the electrostatic characteristics, dark charge retention rate (D.R.R.) and photosensitivity are particularly affected.

Techniques for improvements in smoothness and electrostatic characteristics of a photoconductive layer by using a resin having a low molecular weight and containing a component having an acidic group are described, for example, in JP-A-63-217354 and JP-A-3 -181948, (the term "JP-A" as used herein means an "unexamined published Japanese Patent Application"), U.S. Pat. Nos. 4,968,572, 5,021,311, 5,134,051, 4,495,407, 5,063,130, 5,183,721, 5,147,752, 5,089,368 and 5,154,997, and EP-A-0432727. It is presumed that even when the stoichiometric defect of the inorganic photoconductive substance varies to some extents, a relatively stable interaction between the inorganic photoconductive substance, spectral sensitizing dye and resin may be maintained since these various low molecular weight resins have the sufficient adsorptive domain by their functions and mechanisms. Of these resins, the graft type copolymer and AB block copolymer can provide a relatively stable performance even when ambient conditions are fluctuated.

Further, techniques for improving a mechanical strength of a photoconductive layer by using the above described low molecular weight resin containing an acidic group together with a medium to high molecular weight resin are described, for example, in U.S. Pat. Nos. 5,183,720, 5,104,759, 5,124,221, 5,135,830, 5,116,710, 5,206,104, 5,183,721, 5,202,208, 5,206,105, 5,135,831 and 5,089,368, EP-A-0458298, JP-A-3-188454, JP-A-3 -223761, JP-A-3-217846, JP-A-4-14050, JP-A-4-15654, JP-A- 4-20969 and JP-A-4-25851.

However, it has been found that, even in a case of using these resins or a combination of these resins, a problem may arise sometimes on a mechanical strength of the photoconductive layer formed in practice. For instance, when the light-sensitive material is supplied to a duplicating machine or a plate-making machine in the form of a sheet or roll, a surface of the photoconductive layer is always in contact with a rear surface of the light-sensitive material and it is unavoidable that the surface of the photoconductive layer is intensely rubbed sometimes. As the result, a problem arises in a duplicated image formed through an electrophotographic process in that cut of image or background stain in the non-image area occurs in the portion where the surface of the photoconductive layer has been rubbed.

Also, it is desirable to maintain good and stable reproducibility of duplicated image in the case of greatly fluctuating the ambient conditions from high-temperature and high-humidity to low-temperature and low-humidity. In particular, in a scanning exposure system using a semiconductor laser beam, the exposure time becomes longer and also there is a restriction on the exposure intensity as compared with a conventional overall simultaneous exposure system using a visible light, and hence a higher performance has been required for the electrostatic characteristics, in particular, the dark charge retention characteristics and photosensitivity.

Moreover, it has been desired to develop a technique which can faithfully reproduce highly accurate images of continuous gradation as well as images composed of lines and dots using a liquid developer.

However, as a result of evaluation on practical image reproducibility of hitherto known light-sensitive materials it is found that some problems arise in that gradation of the duplicated image becomes soft, in that edge marks of originals pasted up appear and in that unevenness of density occurs at a continuous gradation portion of the duplicated image practically formed in spite of good electrostatic characteristics.

Particularly, when the scanning exposure system using a semiconductor laser beam is applied to hitherto known light-sensitive materials for electrophotographic lithographic printing plate precursors, unevenness of density at a continuous gradation portion occurs on prints or unevenness of white spots at a high density image portion on prints occurs under low humidity conditions. Specifically, in the hitherto known technique, the improved image reproducibility which is achieved by means of the low molecular weight resin may be sometimes deteriorated by the medium to high molecular weight resin used together therewith. In fact, it has been found that an electrophotographic light-sensitive material having a photoconductive layer wherein the above described known resins are used in combination may cause a problem on reproducibility of the above described highly accurate image (particularly, an image of continuous gradation) or on image forming performance in case of using a scanning exposure system with a laser beam of low power.

The present invention has been made for solving the problems of hitherto known electrophotographic light-sensitive materials as described above.

An object of the present invention is to provide an electrophotographic light-sensitive material having an extremely good anti-abrasion property and excellent reproducibility of duplicated images and giving clear good images.

Another object of the present invention is to provide an electrophotographic light-sensitive material having stable and excellent electrostatic characteristics and giving clear good images even when the ambient conditions during the formation of duplicated images are fluctuated to low-temperature and low-humidity or to high-temperature and high-humidity.

A further object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing plate precursor having excellent electrostatic characteristics (in particular, dark charge retention characteristics and photosensitivity), capable of reproducing a faithfully duplicated image to the original (in particular, a highly accurate image of continuous gradation), forming neither overall background stains nor dotted background stains of prints, and showing excellent printing durability.

Other objects of the present invention will become apparent from the following description.

DISCLOSURE OF THE INVENTION

It has been found that the above described objects of the present invention are accomplished by an electrophotographic light-sensitive material having a photoconductive layer containing at least an inorganic photoconductive substance, a spectral sensitizing dye and a binder resin, wherein the binder resin comprises at least one resin (A) shown below and at least one resin (B) shown below.

Resin (A):

A polymer having an acid value of from 5 to 120 and a weight average molecular weight of from $1\times10^3$ to $2\times10^4$ and containing a component represented by the general formula (I) described below and a component containing at least one polar group selected from $—PO_3H_2$, —COOH, $—SO_3H$, $—SO_2H$, a phenolic hydroxy group, $—P(=O)(OH)R^1$ (wherein $R^1$ represents a hydrocarbon group or $—OR^2$ (wherein $R^2$ represents a hydrocarbon group)) and a cyclic acid anhydride group.

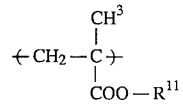

(I)

wherein $R^{11}$ represents a hydrocarbon group.

Resin (B):

An AB or ABA block copolymer having a weight average molecular weight of from $3\times10^4$ to $1\times10^6$ and comprising an A block containing at least a component represented by the general formula (II) described below and a B block containing at least a component corresponding to a monofunctional macromonomer ($M_B$) described below.

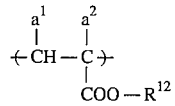

(II)

wherein $a^1$ and $a^2$ each represents a hydrogen atom, a halogen atom, a cyano group, a hydrocarbon group, $—COOR^4$ or $—COOR^4$ bonded via a hydrocarbon group (wherein $R^4$ represents a hydrocarbon group); and $R^{12}$ represents a hydrocarbon group.

Monofunctional Macromonomer ($M_B$):

A monofunctional macromonomer having a weight average molecular weight from $1\times10^3$ to $2\times10^4$ and a polymerizable double bond group at only one terminal of the polymer main chain containing a component having at least one polar group selected from $—PO_3H_2$, —COOH, $—SO_3H$, $—P(=O)(OH)R^1$ (wherein $R^1$ has the same meaning as defined above) and a cyclic acid anhydride group.

In short, the binder resin which can be used in the present invention comprises at least a low molecular weight polymer containing a component represented by the general formula (I) and a component containing the specified polar group described above (resin (A)), and a medium to high molecular weight AB or ABA block copolymer comprising an A block which contains a component represented by the general formula (II) but does not contain the specified polar group-containing component described above and a B block containing at least a monofunctional macromonomer ($M_B$) which contains the specified polar group-containing component described above as a polymer component (resin (B)).

It is important that a binder resin of a photoconductive layer can act for sufficiently and uniformly dispersing particles of inorganic photoconductive substance to form a state under which the occurrence of aggregation of photoconductive substance is restrained and does not disturb sufficient adsorption of spectral sensitizing dye and chemical sensitizer on the surface of particles of the photoconductive substance.

The resin (A) and resin (B) according to the present invention may suitably form the state described above.

Specifically, since the resin (A) according to the present invention is a low molecular weight polymer and contains a large amount of the specified polar group-containing components which can act to adsorb on particles of photoconductive substance, it is selectively adsorbed sufficiently on the particles of photoconductive substance as compared with the resin (B) to thereby disperse uniformly the particles. Further, it acts to restrain the occurrence of aggregation of the particles of photoconductive substance due to its short polymer chain. Therefore, it is presumed that, even when the stoichiometric defect portion of the inorganic photoconductive substance varies to some extents, the stable interaction of the inorganic photoconductive substance with the resin (A) used in the present invention is always maintained since the resin (A) has the sufficient adsorptive domain. Also, the resin (A) has the important function in that it does not disturb adsorption of an additive such as a spectral sensitizing dye and a chemical sensitizer on the particles of photoconductive substance.

On the other hand, the resin (B) which is employed together with the low molecular weight resin (A) as a medium to high molecular weight resin according to the present invention is characterized in that it has a lower content of the specified polar group-containing component than the resin (A) used together therewith and in that it contains the polar group in the specific position of a block polymer of the resin (B) as illustrated below.

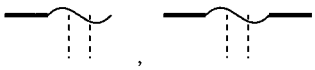

: A block (a part of polymer which does not contain the specified polar group)

: B block (a part of polymer formed by polymerization of macromonomer containing the specified polar groups)

: Macromonomer portion (a portion containing the specified polar groups at random or as a block)

It is believed that the resin (B) according to the present invention may be adsorbed on the particles of inorganic photoconductive substance at the part corresponding to the macromonomer containing the polar group-containing component of the B block and the A block which does not contain the polar group-containing component is present away from the surface of the particles. Accordingly, the resin (B) does not disturb the adsorption of the resin (A) and other additives on the inorganic photoconductive substance. Further, it is presumed that the A block parts having a sufficiently long polymer chain may intertwine each other.

As the result, the electrophotographic light-sensitive material containing the resin (A) and resin (B) as binder resins according to the present invention exhibits the good and stable reproducibility of duplicated image even when the ambient conditions are fluctuated. The electrophotographic light-sensitive material also has the extremely improved mechanical strength of the photoconductive layer and the good resistance against abrasion and is prevented from the phenomenon of the so-called pressure fog.

This effect is especially remarkable in a case wherein polymethine dyes or phthalocyanine series pigments which are particularly effective as spectral sensitizing dyes for the region of near-infrared to infrared light are used.

According to a preferred embodiment of the present invention, the resin (A) is a resin (hereinafter sometimes referred to as resin (A')) containing a methacrylate component having a specific substituent and a polar group-containing component represented by the following general formula (Ia) or (Ib):

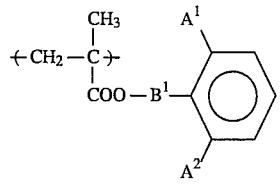

(Ia)

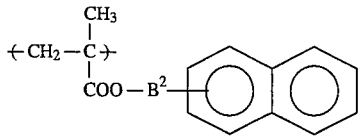

(Ib)

wherein $A^1$ and $A^2$ each represents a hydrogen atom, a hydrocarbon group having from 1 to 10 carbon atoms, a halogen atom, a cyano group, —$COZ^2$ or —$COOZ^2$, wherein $Z^2$ represents a hydrocarbon group having from 1 to 10 carbon atoms; and $B^1$ and $B^2$ each represents a mere bond or a linking group containing from 1 to 4 linking atoms, which connects —COO— and the benzene ring.

In case of using the resin (A'), the electrophotographic characteristics, particularly, $V_{10}$, D.R.R. and $E_{1/10}$ and the reproducibility of duplicated image of the electrophotographic material can be furthermore improved as compared with the use of the resin (A). While the reason for this fact is not fully clear, it is believed that the polymer molecular chain of the resin (A') is suitably arranged on the surface of inorganic photoconductive substance in the layer depending on the plane effect of the benzene ring or naphthalene ring which is an ester component of the methacrylate whereby the above described improvement is achieved.

When the electrophotographic light-sensitive material according to the present invention containing photoconductive zinc oxide as the inorganic photoconductive substance is applied to a conventional direct printing plate precursor, extremely good water retentivity as well as the excellent image forming performance can be obtained. More specifically, when the light-sensitive material according to the present invention is subjected to an electrophotographic process to form an duplicated image, oil-desensitization of non-image portions by chemical treatment with a conventional oil-desensitizing solution to prepare a printing plate, and printing by an offset printing system, it exhibits excellent characteristics as a printing plate.

When the electrophotographic light-sensitive material according to the present invention is subjected to the oil-desensitizing treatment, the non-image portions are rendered sufficiently hydrophilic to increase water retentivity which results in remarkable increase in a number of prints obtained. It is believed that these results are obtained by the fact that the zinc oxide particles are uniformly dispersed in the binder resin and the state of binder resin present on the surface of zinc oxide particles is proper to conduct an oil-desensitizing reaction with the oil-desensitizing solution rapidly and effectively.

Now, the resin (A) which can be used as the binder resin for the photoconductive layer of the electrophotographic light-sensitive material according to the present invention will be described in more detail below.

The weight average molecular weight of the resin (A) is from $1\times10^3$ to $2\times10^4$, and preferably from $3\times10^3$ to $1\times10^4$. The glass transition point of the resin (A) is preferably from −30° C. to 110° C. and more preferably from −20° C. to 90° C.

If the weight average molecular weight of the resin (A) is less than $1\times10^3$, the film-forming property of the resin is lowered, thereby a sufficient film strength cannot be maintained, while if the weight average molecular weight of the resin (A) is higher than $2\times10^4$, the effect of the present invention for obtaining stable duplicated images is reduced since fluctuations of dark charge retention rate and photosensitivity of the photoconductive layer, in particular, that containing a spectral sensitizing dye for sensitization in the range of from near-infrared to infrared become somewhat large under severe conditions of high temperature and high humidity or low temperature and low humidity.

The content of the methacrylate component represented by the general formula (I) present in the resin (A) is not less than 40 parts by weight, preferably not less than 50 parts by weight per 100 parts by weight of the total polymer component of the resin (A).

If the content of the component represented by the general formula (I) in the resin (A) is less than 40 parts by weight, the initial potential is insufficient, the dark charge retention rate is low and thus the image density of duplicated image practically obtained tends to decrease.

The content of the component containing at least one polar group selected from the above-described specified polar groups present in the resin (A) is determined within a range of from 5 to 120, preferably from 10 to 100, in terms of an acid value of the Resin (A) (i.e., KOH mg/g of the resin).

If the acid value of the resin (A) is less than 5, the initial potential is low and thus satisfactory image density is hardly obtained. On the other hand, if the acid value is larger than 120, the dispersibility of particles of the photoconductive substance becomes poor even though the resin has a low molecular weight, smoothness and electrophotographic characteristics of the photoconductive layer are decreased under conditions of high temperature and high humidity, and further when the light-sensitive material is used as an offset master plate, the occurrence of background stains may increase.

The methacrylate component represented by the general formula (I) which is contained in the resin (A) according to the present invention will be described in greater detail below.

In the repeating unit represented by the general formula (I), the hydrocarbon group of $R^{11}$ may be substituted.

$R^{11}$ preferably represents a hydrocarbon group having from 1 to 18 carbon atoms, which may be substituted. The substituent for the hydrocarbon group may be any substituent other than the polar groups contained in the resin (A) according to the present invention described above. Suitable examples of the substituent include a halogen atom (e.g., fluorine, chlorine, and bromine), —$OZ^1$, —$COOZ^1$, and —$OCOZ^1$ (wherein $Z^1$ represents an alkyl group having from 1 to 22 carbon atoms, e.g., methyl, ethyl, propyl, butyl, hexyl, octyl, decyl, dodecyl, hexadecyl, and octadecyl). Preferred examples of the hydrocarbon group represented by $R^{11}$ include an alkyl group having from 1 to 18 carbon atoms which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

More preferably, the component corresponding to the repeating unit represented by the general formula (I) in the resin (A) is a methacrylate component having the specific aryl group represented by the general formula (Ia) and/or (Ib) described above.

In the general formula (Ia), $A^1$ and $A^2$ each preferably represents a hydrogen atom, a halogen atom (e.g., chlorine, and bromine), a cyano group, as a hydrocarbon group having from 1 to 10 carbon atoms, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), —$COZ^2$ or —$COOZ^2$ (wherein $Z^2$ preferably represents any of the above-recited hydrocarbon groups described as preferred hydrocarbon groups having from 1 to 10 carbon atoms).

In the general formulae (Ia) and (Ib), $B^1$ and $B^2$ each represents a mere bond or a linking group containing from 1 to 4 linking atoms which connects between —COO— and the benzene ring, e.g., $$\text{-}(CH_2)_a\text{-}$$

(wherein a represents an integer of from 1 to 3), —$CH_2OCO$—, —$CH_2CH_2OCO$—, $$\text{-}(CH_2O)_b\text{-}$$

(wherein b represents an integer of 1 or 2), and —$CH_2CH_2O$—, and preferably represents a mere bond or a linking group containing from 1 to 2 linking atoms.

Specific examples of the component corresponding to the repeating unit represented by the general formula (Ia) or (Ib) which can be used in the resin (A) according to the present invention are set forth below, but the present invention should not be construed as being limited thereto. In the following formulae (a-1) to (a-17), n represents an integer of from 1 to 4; m represents an integer of from 0 to 3; p represents an integer of from 1 to 3; $R_{30}$ to $R_{33}$ each represents $$-C_nH_{2n+1} \text{ or } -(CH_2)_m\text{-}C_6H_5$$

(wherein n and m each has the same meaning as defined above); and $X_1$ and $X_2$, which may be the same or different, each represents a hydrogen atom, —Cl, —Br or —I.

(a-1)
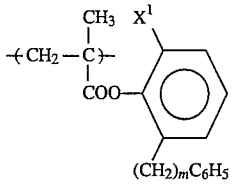
(a-2)
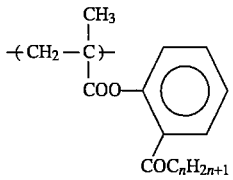
(a-3)
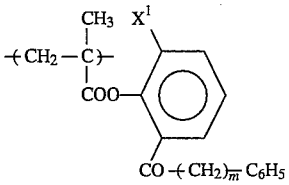
(a-4)
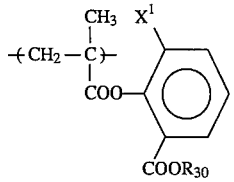
(a-5)
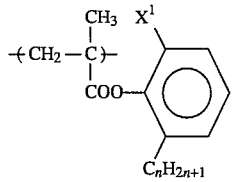
(a-6)
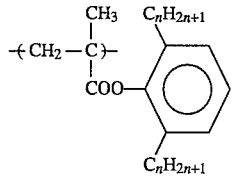
(a-7)
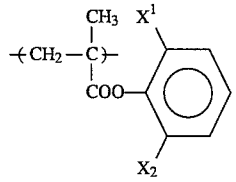
(a-8)
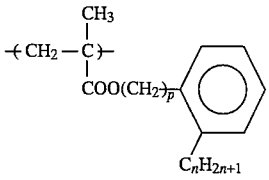
-continued
(a-9)
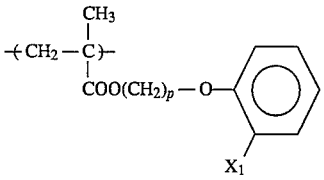
(a-10)
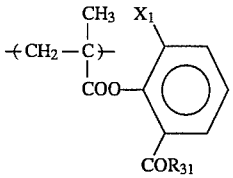
(a-11)
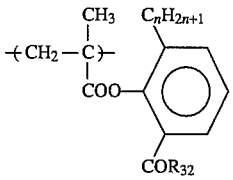
(a-12)
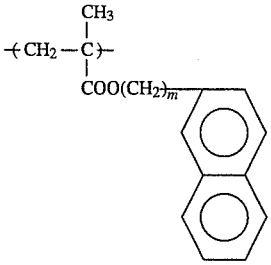
(a-13)
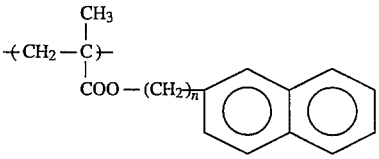
(a-14)
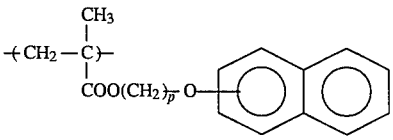
(a-15)
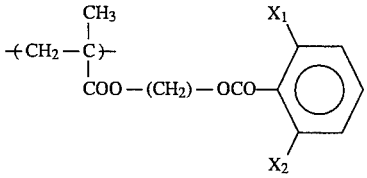
(a-16)
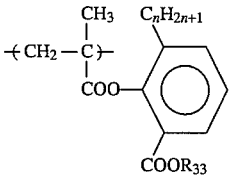

-continued

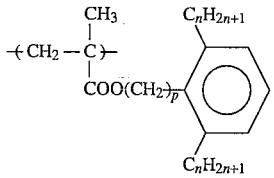

(a-17)

Now, the component having the specified polar group present in the resin (A) will be described in detail below.

The resin (A) is a polymer having an acid value of from 5 to 120 and the acid value originates from the specified polar group-containing component contained in the resin (A).

The polar group included in the polar group-containing component is selected from $—PO_3H_2$, —COOH, $—SO_3H$, $—SO_2H$, a phenolic hydroxy group, $—P(=O)(OH)R^1$ and a cyclic acid anhydride group as described above.

The $—P(=O)(OH)R^1$ denotes a group represented by the following formula:

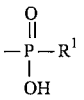

wherein $R^1$ represents a hydrocarbon group or $—OR^2$ (wherein $R^2$ represents a hydrocarbon group).

The hydrocarbon group represented by $R^1$ or $R^2$ preferably includes an aliphatic group having from 1 to 22 carbon atoms which may be substituted (e.g., methyl, ethyl, propyl, butyl, hexyl, octyl, decyl, dodecyl, octadecyl, propenyl, methoxymethyl, ethoxymethyl, 2 -ethoxyethyl, 2-chloroethyl, 2-bromoethyl, 2-methoxyethyl, 2-fluoroethyl, 3-chloropropyl, 3-methoxypropyl, 3-ethoxypropyl, 2-methoxybutyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

The phenolic hydroxy group is a hydroxy group bonded to an aromatic ring, for example, benzene and naphthalene. Suitable examples of the components containing a phenolic hydroxy group include methacrylic acid esters or amides having a hydroxyphenyl group or a hydroxynaphthyl group as a substituent.

The cyclic acid anhydride group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane- 1,2-dicarboxylic acid anhydride ring, cyclohexane- 1,2-dicarboxylic acid anhydride ring, cyclohexene- 1,2-dicarboxylic acid anhydride ring, and 2,3-bicyclo[ 2,2,2]octanedicarboxylic acid anhydride. These rings may be substituted with, for example, a halogen atom (e.g., chlorine and bromine), and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxy and ethoxy as the alkoxy group).

In the present invention, the component having the specified polar group can exist either in the polymer chain and/or at one terminal of the polymer main chain of the resin (A).

In a case wherein the polar group is included in a component corresponding to a repeating unit of the resin (A), the polar group may be bonded to a component constituting the polymer chain either directly or via an appropriate linking group. The linking group can be any group for connecting the polar group to the component constituting the polymer chain. Specific examples of suitable linking group include

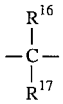

(wherein $R^{16}$ and $R^{17}$, which may be the same or different, each represents a hydrogen atom, a halogen atom (e.g., chlorine, and bromine), a hydroxyl group, a cyano group, an alkyl group (e.g., methyl, ethyl, 2-chloroethyl, 2-hydroxyethyl, propyl, butyl, and hexyl), an aralkyl group (e.g., benzyl and phenethyl), or a phenyl group),

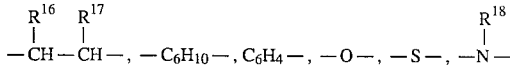

(wherein $R^{18}$ represents a hydrogen atom or a hydrocarbon group (preferably having from 1 to 12 carbon atoms (e.g., methyl, ethyl, propyl, butyl, hexyl, octyl, decyl, dodecyl, 2-methoxyethyl, 2-chloroethyl, 2-cyanoethyl, benzyl, methylbenzyl, phenethyl, phenyl, tolyl, chlorophenyl, methoxyphenyl, and butylphenyl)),

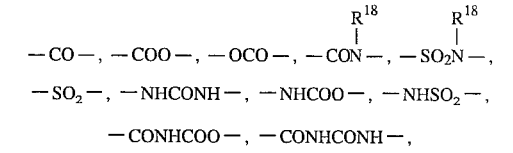

a heterocyclic ring (preferably a 5-membered or 6-membered ring containing at least one of an oxygen atom, a sulfur atom and a nitrogen atom as a hetero atom or a condensed ring thereof (e.g., thiophene, pyridine, furan, imidazole, piperidine, and morpholine rings)),

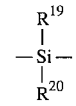

(wherein $R^{19}$ and $R^{20}$, which may be the same or different, each represents a hydrocarbon group or $—OR^{21}$ (wherein $R^{21}$ represents a hydrocarbon group)), and a combination of two or more thereof. Suitable examples of the hydrocarbon groups include those described for $R^{18}$.

A monomer forming the polar group-containing component may be any of specified polar group-containing vinyl compounds copolymerizable with, for example, a monomer corresponding to the repeating unit represented by the general formula (I) (including that represented by the general formula (Ia) or (Ib)). Examples of such vinyl compounds are described, e.g., in Kobunshi Gakkai (ed.), *Kobunshi Data Handbook* (*Kiso-hen*), Baifukan (1986). Specific examples of these vinyl monomers include acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the specific polar group in the substituent thereof.

The total amount of the component containing the above-described specified polar group present in the resin (A) is so decided that the acid value of the resin (A) is in a range of from 5 to 120.

When the content of the component containing the specified polar group present in the resin (A) is indicated in terms of a weight ratio, it is from 0.5 to 15 parts by weight, preferably from 1 to 10 parts by weight per 100 parts by weight of the resin (A).

In the resin (A), the ratio of the polar group present in the polymer chain to the polar group bonded to the terminal of the polymer main chain may be varied depending on the kinds and amounts of other binder resins, a spectral sensitizing dye, a chemical sensitizer and other additives which constitute the photoconductive layer according to the present invention, and can be appropriately controlled. What is important is that the total amount of the polar group-containing component present in the resin (A) is in the range described above.

Specific examples of the polar group-containing components of such a type are set forth below, but the present invention should not be construed as being limited thereto. In the following formulae, $e_1$ represents —H or —$CH_3$; $e_2$ represents —H, —$CH_3$ or —$CH_2COOCH_3$; $R_{14}$ represents an alkyl group having from 1 to 4 carbon atoms; $R_{15}$ represents an alkyl group having from 1 to 6 carbon atoms, a benzyl group or a phenyl group; c represents an integer of from 1 to 3; d represents an integer of from 2 to 11; e represents an integer of from 1 to 11; f represents an integer of from 2 to 4; and g represents an integer of from 2 to 10.

(b-1)

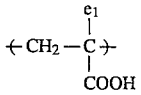

(b-2)

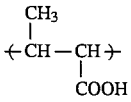

(b-3)

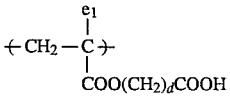

-continued (b-4)

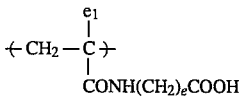

(b-5)

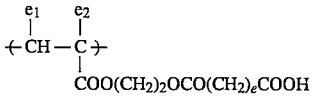

(b-6)

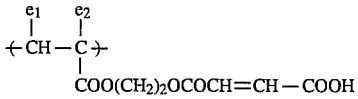

(b-7)

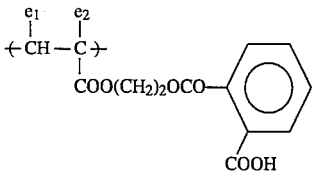

(b-8)

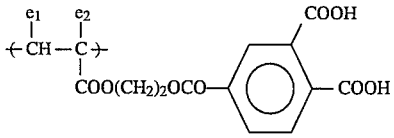

(b-9)

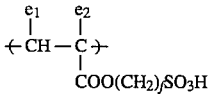

(b-10)

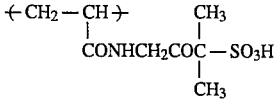

(b-11)

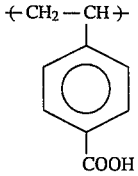

(b-12)

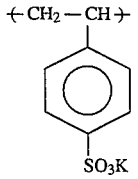

(b-13)

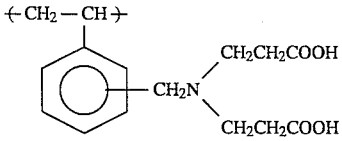

(b-14)

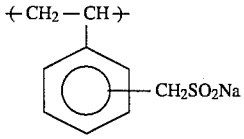

-continued
(b-15)
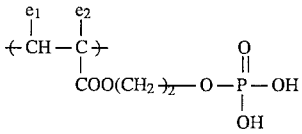
(b-16)
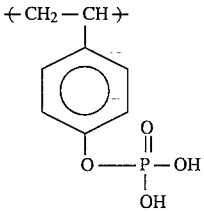
(b-17)
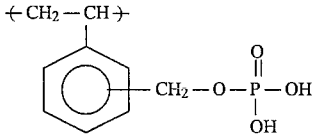
(b-18)
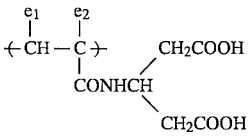
(b-19)
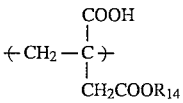
(b-20)
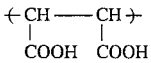
(b-21)
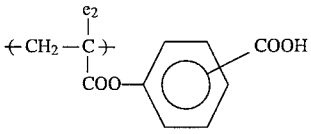
(b-22)
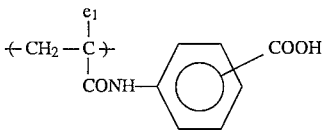
(b-23)
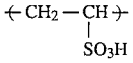
(b-24)
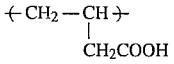
(b-25)
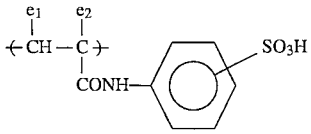
(b-26)
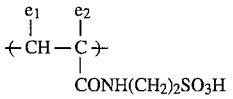
-continued
(b-27)
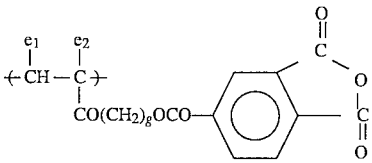
(b-28)
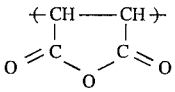
(b-29)
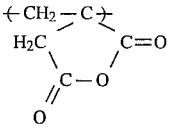
(b-30)
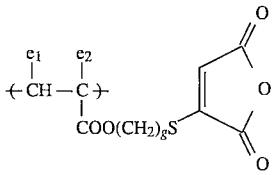
(b-31)
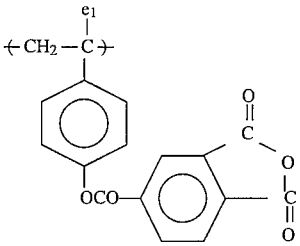
(b-32)
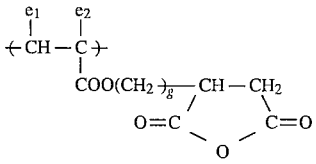
(b-33)
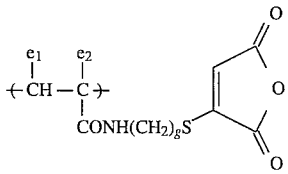
(b-34)
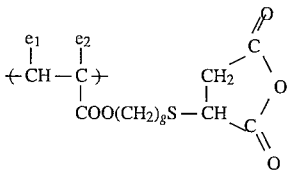
(b-35)
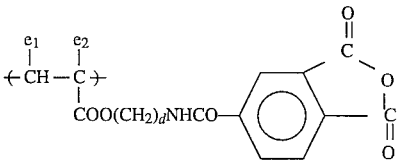

-continued (b-36)

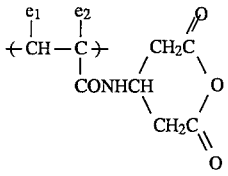

(b-37)

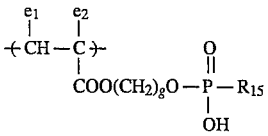

(b-38)

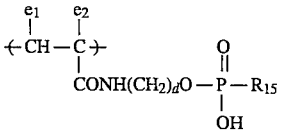

(b-39)

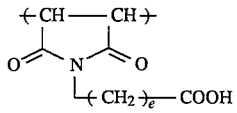

(b-40)

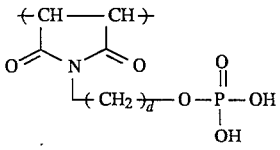

(b-41)

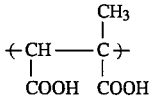

(b-42)

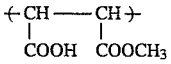

(b-43)

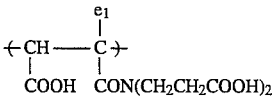

(b-44)

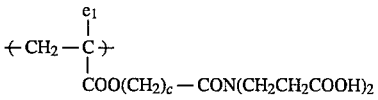

(b-45)

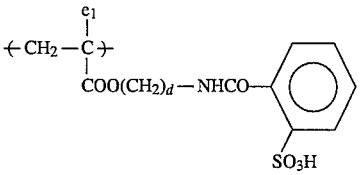

(b-46)

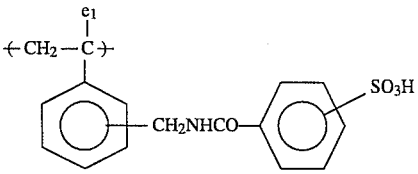

-continued (b-47)

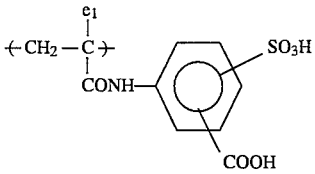

(b-48)

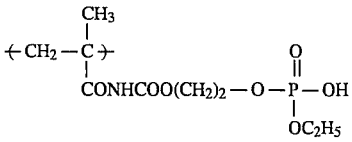

(b-49)

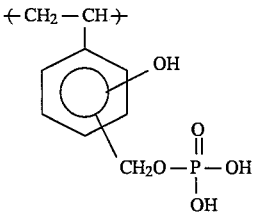

(b-50)

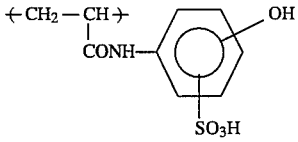

(b-51)

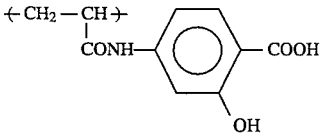

(b-52)

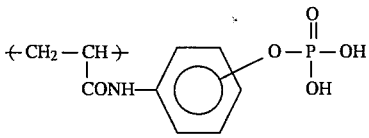

(b-53)

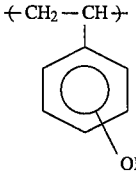

(b-54)

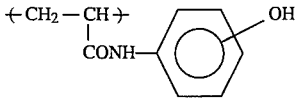

The resin (A) according to the present invention may contain other component(s) in addition to the component of the general formula (I) and the polar group-containing component. As such a component, a component of the general formula (II) described with respect to the resin (B) is preferred.

In the general formula (II), $a^1$ and $a^2$ each represents a hydrogen atom, a halogen atom (e.g., chlorine, and bromine), a cyano group, a hydrocarbon group, preferably an alkyl group having from 1 to 4 carbon atoms (e.g., methyl, ethyl, propyl and butyl), —$COOR^4$ or —$COOR^4$ bonded via a hydrocarbon group (wherein $R^4$ represents a hydrocarbon group, preferably an alkyl, alkenyl, aralkyl, alicyclic or aryl group which may be substituted, and specifically includes those as described for $R^{11}$ in the general formula (I) above). Particularly preferably $a^1$ represents a hydrogen atom and $a^2$ represents a methyl group.

The hydrocarbon group in the above described —$COOR^4$ group bonded via a hydrocarbon group includes, for example, a methylene group, an ethylene group, and a propylene group.

$R^{12}$ represents a hydrocarbon group including specifically an alkyl group, an alkenyl group, an aralkyl group, an alicyclic group and an aromatic group, and preferably an aralkyl group or an aryl group, which is a hydrocarbon group containing a benzene ring or a naphthalene ring. Specific examples of the hydrocarbon group represented by $R^{12}$ include those as described for $R^{11}$ in the general formula (I) above.

The resin (A) according to the present invention may further contain component(s) other than the component of the general formula (I), the specified polar group-containing component and the above-described component of the general formula (II). Such other components may include any component capable of being copolymerized with the components described above.

Examples of such other components include a component represented by the following general formula (III):

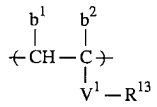

(III)

wherein $V^1$ represents

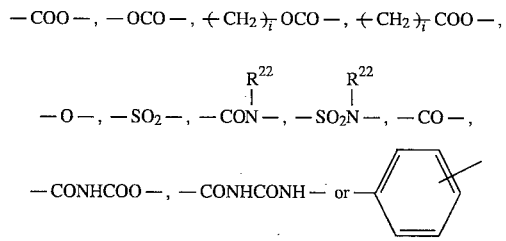

(wherein i represents an integer of from 1 to 3; and $R^{22}$ represents a hydrogen atom or a hydrocarbon group); $R^{13}$ represents a hydrocarbon group; and $b^1$ and $b^2$, which may be the same or different, each has the same meaning as $a^1$ or $a^2$ in the general formula (II) described above.

Preferred examples of the hydrocarbon group represented by $R^{22}$ include an alkyl group having from 1 to 18 carbon atoms which may be substituted (e.g., methyl, ethyl, propyl, butyl, heptyl hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

When $V^1$ represents

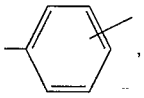

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

Preferred examples of the hydrocarbon group represented by $R^{13}$ include an alkyl group having from 1 to 22 carbon atoms which may be substituted (e.g., methyl, ethyl, propyl, butyl, heptyl hexyl, octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

More preferably, in the general formula (III), $V^1$ represents

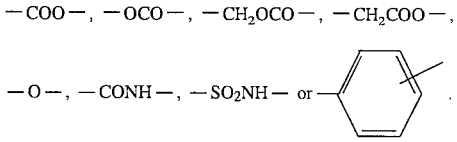

Moreover examples of other copolymerizable component constituting a repeating unit contained in the resin (A) include, in addition to methacrylic acid esters, acrylic acid esters and crotonic acid esters containing substituents other than those described for the general formula (I), α-olefins, vinyl or allyl esters of carboxylic acids (including, e.g., acetic acid, propionic acid, butyric acid, valeric acid, benzoic acid, and naphthalenecarboxylic acid, as examples of the carboxylic acids), acrylonitrile, methacrylonitrile, vinyl ethers, itaconic acid esters (e.g., dimethyl ester and diethyl ester), acrylamides, methacrylamides, styrenes (e.g., styrene, vinyltoluene, chlorostyrene, hydroxystyrene, N,N-dimethylaminomethylstyrene, methoxycarbonylstyrene, methanesulfonyloxystyrene, and vinylnaphthalene), vinylsulfone-containing compounds, vinylketone-containing compounds, and heterocyclic vinyl compounds (e.g., vinylpyrrolidone, vinylpyridine, vinylimidazole, vinylthiophene, vinylimidazoline, vinylpyrazoles, vinyldioxane, vinylquinoline, vinyltetrazole, and vinyloxazine).

As described above, the resin (A) according to the present invention may be any type of polymer as far as it contains the component represented by the general formula (I) and has the component containing the specified polar group in the polymer chain and/or at one terminal of the polymer main chain.

More specifically, the resin (A) containing the specified polar group includes the following embodiments:

Resin ($A_1$):

A homo or random polymer containing the component of the general formula (I) and having the polar group-containing component in the polymer chain and/or at one terminal of the polymer main chain.

Resin ($A_2$):

An AB block polymer comprising an A block containing the component of the general formula (I) and a B block containing the polar group-containing component.

Resin ($A_3$):

A graft polymer comprising the component of the general formula (I) and a component corresponding to a monofunctional macromonomer having a weight average molecular weight of from $1\times10^3$ to $2\times10^4$ and a polymerizable double bond group at one terminal of the polymer chain and having the polar group-containing component in the polymer chain of the macromonomer and/or at one terminal of the polymer main chain of the graft polymer.

Resin ($A_4$):

A starlike polymer comprising an organic molecule having bonded thereto at least three polymer chains each containing the component of the general formula (I) and the polar group-containing component.

These homo or random polymer (resin ($A_1$)), AB block polymer (resin ($A_2$)), graft polymer (resin ($A_3$)) and starlike polymer (resin ($A_4$)) are schematically illustrated below.

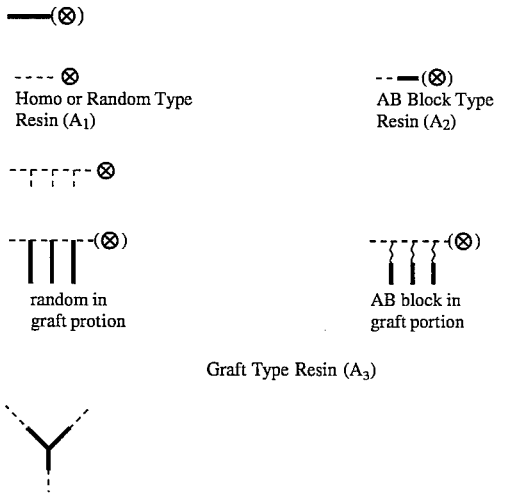

Graft Type Resin ($A_3$)

-continued

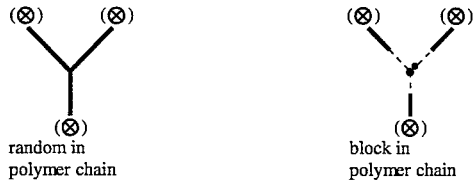

Starlike Type Resin ($A_4$)

- - · : a polymer chain which contains the component of the general formula (I) and does not contain the specified polar group-containing component — : a polymer chain which contains the specified polar group-containing component

- -⊗ : the specified polar group-containing component is bonded at the terminal

— (⊗): the specified polar group-containing component may or may not be bonded at the terminal
- - (⊗)

~ : a polymer chain which does not contain the specified polar group-containing component and may or may not contain the component of the general formula (I)

Now, each embodiment of the resin (A) according to the present invention shown schematically above will be described in detail below.

The resin ($A_1$) of a homo or random polymer is a polymer containing the component represented by the general formula (I) (preferably, the general formula (Ia) and/or (Ib)) and having the specified polar group-containing component in the polymer chain and/or at one terminal of the polymer main chain. When the resin ($A_1$) contains the polar group-containing components in the polymer chain, the components are present at random (a random polymer).

In the resin ($A_1$), the total amount of the polar group-containing component including the component present in the polymer chain and the component present at the terminal of the main chain is so determined that the acid value of the resin ($A_1$) is in a range of from 5 to 120.

The resin ($A_2$) of an AB block polymer is a polymer comprising an A block which contains the component of the general formula (I) and does not contain the polar group-containing component and a B block which contains the polar group-containing component. The resin ($A_2$) may have the specified polar group-containing component at a terminal of the main chain of the B block which terminal is opposite to the terminal at which the B block is bonded to the A block.

The A block of the resin ($A_2$) may contain two or more components represented by the general formula (I) (preferably, the general formula (Ia) and/or (Ib) and may further contain other component(s). Suitable examples of other components include the component of the general formula (II), the component of the general formula (III) and the other component which may be present in the resin (A) described above.

When the A block contains two or more components, these components may be present either at random or as a block, preferably at random.

The content of the component represented by the general formula (I) in the A block of the resin ($A_2$) is preferably from 40 to 100% by weight, more preferably from 50 to 100% by weight based on the A block.

The B block of the resin ($A_2$) may be composed of the polar group-containing component alone or together with other component(s).

The content of the polar group-containing component in the B block is so determined that the acid value of the resin ($A_2$) is in a range of from 5 to 120, taking the polar group-containing component which may be bonded at the terminal of the main chain thereof into consideration.

The component other than the polar group-containing component which may be present in the B block is not particularly limited. Preferred examples of other components include the component of the general formula (I), the component of the general formula (II), the component of the general formula (III) and the other component which may be present in the resin (A) described above.

The resin ($A_3$) of a graft polymer is a polymer obtained by copolymerization of at least one monomer corresponding to the component represented by the general formula (I) and at least one monofunctional macromonomer ($M_A$) having a weight average molecular weight of from $1\times10^3$ to $2\times10^4$ and a double bond group copolymerizable with the above-described monomer at only one terminal of the polymer chain and having the polar group-containing component in the polymer chain of the macromonomer and/or at one terminal of its polymer main chain.

In the resin ($A_3$) according to the present invention, the total amount of the specified polar group-containing component including the component present at the terminal of the main chain of the graft polymer and the component present in the graft portion is so determined that the acid value of the resin ($A_3$) is in a range of from 5 to 120.

The content of the macromonomer ($M_A$) in the resin ($A_3$) is usually from 1 to 70% by weight, preferably from 5 to 50% by weight.

If the content of the macromonomer in the resin ($A_3$) is less than 1% by weight, the electrophotographic characteristics (particularly, dark charge retention rate and photoconductivity) tend to decrease, and the fluctuation of electrophotographic characteristics depending on the change in ambient conditions tends to increase particularly in a combination of a spectral sensitizing dye for the region of near-infrared to infrared light. On the other hand, if the content of the macromonomer exceeds 70% by weight, copolymerizability of the macromonomer with monomer(s) corresponding to other component(s) becomes insufficient and the satisfactory electrophotographic characteristics tend to be hardly obtained when used as a binder resin.

The content of the component corresponding to the repeating unit of the general formula (I) copolymerizable with the macromonomer in the resin ($A_3$) is preferably not less than 40% by weight and more preferably not less than 50% by weight.

The monofunctional mocromonomer ($M_A$) used in the present invention has a polymerizable double bond group bonded at one terminal of its main chain comprising a component constituting a repeating unit. Suitable examples of the polymerizable double bond group include the group represented by the general formula (IV) described hereinafter. The polymerizable double bond group may be bonded to the terminal of the polymer chain either directly or through an appropriate linking group. Suitable examples of the linking group include those described in a case wherein the polar group is bonded to a component constituting the polymer chain of the resin (A) hereinbefore.

Repeating units which constitute the macromonomer ($M_A$) include those containing none of the specified polar group-containing component (in case of a macromonomer ($M_{A1}$)) and those containing the specified polar group-containing component (in case of a macromonomer ($M_{A2}$)).

Components constituting the macromonomer ($M_{A1}$) which does not contain the polar group-containing component are preferably the same as those described with respect to the A block of the AB block polymer of the resin ($A_2$) above. When the macromonomer ($M_A$) does not contain the polar group-containing component, the resin ($A_3$) has the polar group-containing component at the terminal of its polymer main chain. In this case, the content of the polar group-containing component is so determined that the acid value of the resin ($A_3$) is in a range of from 5 to 120.

In the macromonomer ($M_{A2}$) comprising the polar group-containing component, the polar group-containing components may be present at random or as a block in the polymer chain of macromonomer ($M_{A2}$). In a case wherein the polar group-containing components are present as a block, the block containing the polar group is bonded to the terminal of a block which does not contain the polar group opposite to the terminal to which the polymerizable double bond group is bonded.

Components constituting the macromonomer ($M_{A2}$) comprising the polar group-containing component at random are preferably the same as those described with respect to the ransom polymer of the resin ($A_1$) above.

In the macromonomer ($M_{A2}$) comprising the polar group-containing component as a block, the polar group-containing block may contain a component which does not contain the polar group in addition to the polar group-containing component. However, it is preferred that the content of the polar group-containing component in the block is 30 to 100% by weight.

In the macromonomer ($M_{A2}$) comprising the polar group-containing component as a block, a component constituting the block which does not contain the polar group may be any one which does not contain the polar group as well as the component of the general formula (I).

Components constituting the macromonomer ($M_{A2}$) comprising the polar group-containing component as a block are preferably the same as those described with respect to the AB block polymer of the resin ($A_2$) above.

The resin ($A_4$) of a starlike polymer is a polymer comprising an organic molecule having bonded thereto at least three polymer chains each containing at least one component represented by the general formula (I) and at least one component containing the specified polar group. The resin ($A_4$) may have the specified polar group-containing component at a terminal of the polymer chain which terminal is opposite to the terminal at which the polymer chain is bonded to the organic molecule.

In the starlike polymer, three or more polymer chains which are bonded to the organic molecule may be the same as or different from each other in their structure as far as each polymer chain contains at least the component of the general formula (I) and the polar group-containing component. Also, the length of each polymer chain may be the same or different. A number of the polymer chains bonded to an organic molecule is at most 15, and usually about 10 or less.

In the resin ($A_4$), the total amount of the polar group-containing component including the component present in the polymer chain and the component present at the terminal of the polymer chain is so determined that the acid value of the resin ($A_4$) is in a range of from 5 to 120.

The polar group-containing component may be present at random or as an AB block in the polymer chain. In the AB block, the A block and the B block in the polymer chain can be arranged in any order. Such a type of the resin can, for example, be schematically illustrated below.

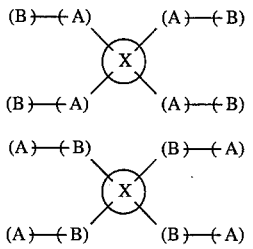

Ⓧ: an organic molecule
(A): a block which does not contain the polar group (A block)
(B): a block which contains the polar group (B block)
(A)—(B): a polymer chain When the polymer chain comprises an AB block and has the specified polar group-containing component at the terminal thereof, the resin has the form of (1) shown above. Specifically, the polar group-containing component is bonded to the terminal of the B block opposite to the terminal at which the B block is bonded to the A block.

In a case wherein the polymer chain comprises a random polymer, components constituting the polymer chain are the same as those described with respect to the random polymer of the resin ($A_1$) above. On the other hand, in a case wherein the polymer chain comprises an AB block polymer, components constituting the polymer chain are the same as those described with respect to the AB block polymer of the resin ($A_2$) above.

The organic molecule to which at least three polymer chains are bonded and which is used in the resin ($A_4$) according to the present invention is any organic molecule having a molecular weight of 1000 or less. Suitable examples of the organic molecules include those containing a trivalent or more hydrocarbon moiety shown below.

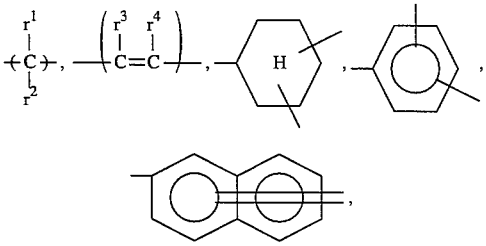

wherein $r^1$, $r^2$, $r^3$ and $r^4$ each represents a hydrogen atom or a hydrocarbon group, provided that at least one of $r^1$ and $r^2$ or $r^3$ and $r^4$ is bonded to a polymer chain.

These organic moieties may be employed individually or as a combination thereof. In the latter case, the combination may further contain an appropriate linking unit, for example, $$-O-,\ -S-,\ -\overset{\overset{r^5}{|}}{N}-$$

(wherein $r^5$ represents a hydrogen atom or a hydrocarbon group), $$-COO-,\ -\overset{\overset{R^5}{|}}{CON}-,\ -SO_2-,\ -\overset{\overset{r^5}{|}}{SO_2N}-,$$

$$-NHCOO-,\ -NHCONH-$$

and a heterocyclic group containing at least one hetero atom such as an oxygen, sulfur or nitrogen atom (e.g., thiophene, pyridine, pyran, imidazole, benzimidazole, furan, piperidine, pyrazine, pyrrole and piperazine, as the hetero ring).

Other examples of the organic molecules to which the polymer chains are bonded include those comprising a combination of $$-\overset{|}{N}- \text{ or } -\underset{|}{\overset{|}{P}}-$$

with a linking unit described above. However, the organic molecules which can be used in the present invention should not be construed as being limited to those described above.

The resin (A) according to the present invention can be synthesized by a polymerization method conventionally known. Specifically, the resin ($A_1$) can be easily synthesized by a method as described, for example, in U.S. Pat. Nos. 5,134,051 and 4,954,407, the resin ($A_2$) can be easily synthesized by a method as described, for example, in EP-A-0432727, the resin ($A_3$) can be easily synthesized by a method as described, for example, in U.S. Pat. Nos. 5,021,311, 5,183,721 and 5,089,368, and the resin ($A_4$) can be easily synthesized by a method as described, for example, in EP-A-0533135.

Now, the resin (B) which can be used as the binder resin for the photoconductive layer of the electrophotographic light-sensitive material according to the present invention will be described in more detail below.

As described above, the resin (B) is an AB or ABA block copolymer comprising an A block which contains the component represented by the general formula (II) and does not contain the specified polar group and a B block containing a component corresponding to a monofunctional macromonomer ($M_B$) which contains the specified polar group-containing component.

When the resin (B) is an ABA block copolymer, the structure and length of polymer chain constituting each A block bonded to the both terminals of the B block may be the same or different as far as each A block contains the component represented by the general formula (II) and does not contain the polar group-containing component contained in the B block.

The weight average molecular weight of the resin (B) is from $3\times10^4$ to $1\times10^6$, and preferably from $5\times10^4$ to $5\times10^5$. If the weight average molecular weight of the resin (B) is less than $3\times10^4$, the film-forming property of the resin is lowered, whereby a sufficient film strength cannot be maintained, while if the weight average molecular weight of the resin (B) is higher than $1\times10^6$, the effect of the resin (B) of the present invention is reduced, whereby the electrophotographic characteristics thereof become almost the same as those of conventionally known resins.

The glass transition point of the resin (B) is preferably from −10° C. to 100° C., and more preferably from 0° C. to 90° C.

In the resin (B) used in the present invention, the content of the monofunctional macromonomer ($M_B$) present in the B block is usually from 1 to 60% by weight, preferably from 5 to 40% by weight based on the B block. If the content of the monofunctional macromonomer ($M_B$) is less than 1% by weight, the effect of graft structure of the B block is lost, whereby the electrophotographic characteristics and water retentivity are degradated. On the other hand, if it exceeds 60% by weight, the copolymerizability of macromonomer with other copolymerizable component(s) undesirably decreases.

The resin (B) contains the specified polar group-containing component usually from 0.05 to 10% by weight, preferably from 0.5 to 8% by weight based on the resin (B).

If the content of the polar group-containing component in the resin (B) is less than 0.05% by weight, the initial potential is low and thus satisfactory image density may not be obtained. On the other hand, if the content of the polar group-containing component is larger than 10% by weight, various undesirable problems may occur, for example, the dispersibility of particles of photoconductive substance is reduced, the film smoothness and the electrophotographic characteristics under high temperature and high humidity condition deteriorate, and further when the light-sensitive material is used as an offset master plate, the occurrence of background stains increases.

It is also preferred that the total amount of the specified polar group-containing component contained in the resin (B) is from 10 to 50% by weight based on the total amount of the specified polar group-containing component present in the resin (A).

If the total amount of the specified polar group-containing component in the resin (B) is less than 10% by weight of that in the resin (A), the electrophotographic characteristics (particularly, dark charge retention rate and photosensitivity) and film strength tend to decrease. On the other hand, if it is larger than 50% by weight, a sufficiently uniform dispersion of particles of photoconductive substance may not be obtained, whereby the electrophotographic characteristics decrease and water retentivity decline when used as an offset master plate.

Now, the component constituting the A block of the resin (B) will be described in detail below.

The A block contains at least the component of a repeating unit represented by the general formula (II). The content of the component represented by the general formula (II) is preferably from 30 to 100% by weight, more preferably from 50 to 100% by weight in the A block.

Details of the component represented by the general formula (II) are same as those described with reference to the resin (A) hereinbefore.

The A block of the resin (B) may contain other component(s) than the component represented by the general formula (II). Suitable examples of other components include the component of the general formula (I), the component of the general formula (III) and the other component which may be present described with respect to the component constituting the resin (A) above. However, the polar group-containing component is excluded.

Now, the component constituting the B block of the resin (B) will be described in detail below.

The B block is characterized in that it contains at least one component corresponding to the monofunctional macromonomer ($M_B$) containing the specified polar group-containing component and does not contain the specified polar group-containing-component as other component.

The weight average molecular weight of the monofunctional macromonomer ($M_B$) is from $1\times10^3$ to $2\times10^4$, preferably from $3\times10^3$ to $1\times10^4$.

If the weight average molecular weight of the macromonomer ($M_B$) exceeds $2\times10^4$, the copolymerizability with other monomer(s) undesirably decreases. On the other hand, if the weight average molecular weight thereof is too small, the effect for improving the electrophotographic characteristics of the light-sensitive layer is reduced, and hence the molecular weight is desirably not less than $1\times10^3$.

The macromonomer ($M_B$) has a polymerizable double bond group at the terminal of its polymer chain. A suitable example of the polymerizable double bond group is represented by the following general formula (IV):

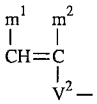

(IV)

wherein $m^1$ and $m^2$ each represents a hydrogen atom, a halogen atom, a trifluoromethyl group, a cyano group, $-COOZ^3$, $-COOZ^3$ via a hydrocarbon group or a hydrocarbon group; and $V^2$ represents $$-COO-,\ -OCO-,\ -(CH_2)_{m3}-OCO-,\ -(CH_2)_{m3}-COO-$$

(wherein $m_3$ represents an integer of from 1 to 3), $$-O-,\ -SO_2-,\ -CO-,\ -\overset{T_1}{\overset{|}{C}}ON-,\ -SO_2\overset{T_1}{\overset{|}{N}}-$$

(wherein $T_1$ represents a hydrogen atom or a hydrocarbon group),

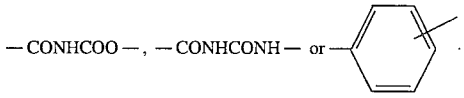

Preferred examples of the hydrocarbon group represented by $T_1$ include an alkyl group having from 1 to 18 carbon atoms which may be substituted (e.g., methyl, ethyl, propyl, butyl, heptyl, hexyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group from 4 to 18 carbon atoms which may be substituted (e.g., 2-methyl-1-propenyl, 2-butentyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2 -naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

When $V^2$ represents

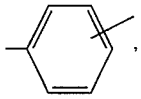

the benzene ring may have a substituent such as, for example, a halogen atom (e.g., chlorine and bromine), an alkyl group (e.g., methyl, ethyl, propyl, butyl chloromethyl, methoxymethyl) and an alkoxy group (e.g., methoxy, ethoxy, propoxy, and butoxy).

In the general formula (IV), $m^1$ and $m^2$, which may be the same or different, each preferably represents a hydrogen atom, a halogen atom (e.g., chlorine and bromine), a trifluoromethyl group, a cyano group, an alkyl group having from 1 to 4 carbon atoms (e.g., methyl, ethyl, propyl, and butyl), —$COOZ^3$, or —$COOZ^3$ bonded via a hydrocarbon group (wherein $Z^3$ represents preferably an alkyl group having from 1 to 18 carbon atoms, an alkenyl group, an aralkyl group, an alicyclic group or an aryl group, these groups may be substituted, and specific examples thereof are the same as those described for $T_1$ above).

The hydrocarbon group through which —$COOZ^3$ is bonded includes, for example, a methylene group, an ethylene group, and a propylene group.

More preferably, in the general formula (IV), $V^2$ represents

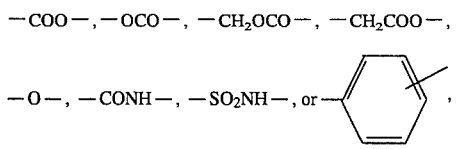

$m^1$ and $m^2$, which may be the same or different, each represents a hydrogen atom, a methyl group, —$COOZ^3$, or —$CH_2COOZ^3$ (wherein $Z^3$ represents preferably an alkyl group having from 1 to 6 carbon atoms (e.g., methyl, ethyl, propyl, butyl, and hexyl)). Further more preferably, one of $m^1$ and $m^2$ represents a hydrogen atom.

The macromonomer ($M_B$) constituting the B block of the resin (B) used in the present invention has a chemical structure in which a polymerizable double bond group preferably represented by the general formula (IV) is bonded to only one terminal of the polymer main chain either directly or through an appropriate linkage group.

The linkage group which can be used includes a carbon-carbon bond (single bond or double bond), a carbon-hetero atom bond (examples of the hetero atom are oxygen, sulfur, nitrogen, and silicon), a hetero atom-hetero atom bond, and an appropriate combination thereof.

Specific examples of the linkage group are the same as those described in the case wherein the polar group is bonded to the component constituting the polymer chain in the resin (A) above.

The macromonomer ($M_B$) contains at least one component containing the specified polar group. The specified polar group present in the resin (B) includes —$PO_3H_2$, —COOH, —$SO_3H$, —P(=O)(OH)$R^1$ (wherein $R^1$ has the same meaning as defined above) and a cyclic acid anhydride group. Specific examples of the specified polar group-containing component are same as those described with respect to the resin (A) above.

Other components constituting the macromonomer ($M_B$) together with the polar group-containing component include the component represented by the general formula (II) described above. The content thereof is usually from 30 to 99.5% by weight, preferably from 50 to 99% by weight in the macromonomer ($M_B$).

The macromonomer ($M_B$) may further contain any other components corresponding to monomers copolymerizable with monomers each corresponding to the polar group-containing component and the component represented by the general formula (II) described above. Such other components may present preferably not more than 30% by weight, more preferably not more than 20% by weight in the macromonomer ($M_B$).

The specified polar group-containing components may be present at random or as a block in the polymer main chain of the macromonomer ($M_B$). When the polar group-containing components are present as a block, the block comprising the polar group-containing component is bonded on the side opposite to that on which the polymerizable double bond group is bonded.

Further, the block containing the polar group-containing component may contain other components. Specific examples thereof include the component which may present in addition to the polar group-containing component in the macromonomer ($M_B$) as described above.

The macromonomer ($M_B$) used in the present invention can be produced by a conventionally known synthesis method. More specifically, it can be produced by the method comprising previously protecting the specific polar group of a monomer corresponding to the component having the polar group to form a functional group, synthesizing a block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagent, and then conducting a protection-removing reaction of the functional group which has been formed by protecting the polar group by a hydrolysis reaction, a hydrogenolysis reaction, an oxidative decomposition reaction, or a photodecomposition reaction to generate the polar group.

An example thereof is shown by the following reaction scheme (1):

Reaction Scheme (1)

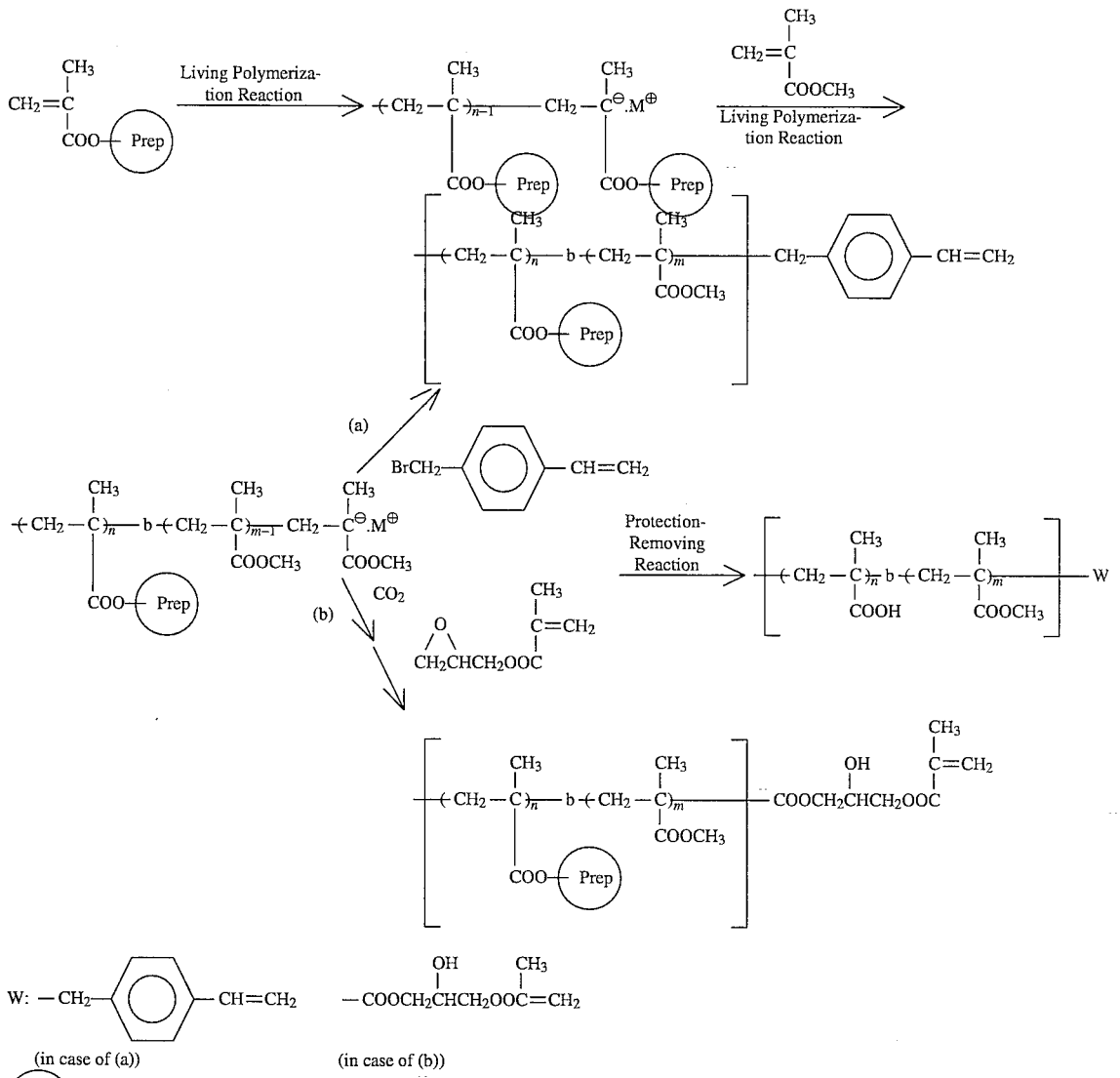

Prep represents a protective group for —COOH,

—b— represents a bond connecting blocks, n and m each represents a repeating unit.

The living polymer can be easily synthesized according to synthesis methods as described, e.g., in P. Lutz, p. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), *ibid.*, 18, 1037 (1986), Koichi Ute and Koichi Hatada, *Kobunshi Kako*, 36, 366 (1987), Toshinobu Higashimura and Mitsuo Sawamoto, *Kobunshi Ronbun Shu*, 46, 189 (1989), M. Kuroki and T. Aida, *J. Am. Chem. Soc.*, 109, 4737 (1987), Teizo Aida and Shohei Inoue, *Yuki Gosei Kagaku*, 43, 300 (1985), and D. Y. Sogah, W. R. Hertler et al, *Macromolecules*, 20, 1473 (1987).

In order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng.*, 7, 51 (1987), P. F. Rempp and E. Franta, *Adv. Polym. Sci.*, 58, 1 (1984), V. Per-cec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references cited in these literatures.

Also, the protection of the specific polar group of the present invention and the release of the protective group (a reaction for removing a protective group) can be easily conducted by utilizing conventionally known techniques. More specifically, they can be performed by appropriately selecting methods as described, e.g., in Yoshio Iwakura and Keisuke Kurita, *Hannosei Kobunshi*, Kodansha (1977), T. W. Greene, *Protective Groups in Organic Synthesis*, John Wiley & Sons (1981), and J. F. W. McOmie, *Protective*

*Groups in Organic Chemistry,* Plenum Press, (1973), as well as methods as described in the above references.

Furthermore, the block copolymer can be also synthesized by a photoinfeter polymerization method using a dithiocarbamate compound as an initiator. For example, the block copolymer can be synthesized according to synthesis methods as described, e.g., in Takayuki Otsu, *Kobunshi,* 37, 248 (1988), Shunichi Himori and Ryuichi Ohtsu, *Polym. Rep. Jap.,* 37, 3508 (1988), JP-A- 64-111, and JP-A-64-26619.

The macromonomer ($M_B$) according to the present invention can be obtained by applying the above described synthesis method for macromonomer to the block copolymer.

The synthesis method of the macromonomer according to the present invention is described more specifically, for example, in U.S. Pat. Nos. 5,183,720 and 5,104,759.

The resin (B) used in the present invention can be synthesized according to a synthesis method for a conventional AB block copolymer. Specifically, the synthesis is conducted with reference to the description of WO 92/18907.

In the resin (B) used in the present invention, a ratio of A block/B block is usually 50 to 99/50 to 1 by weight, preferably 60 to 95/40 to 5 by weight.

The resin (A) used in the photoconductive layer according to the present invention may comprise one, two or more thereof.

The resin (B) used in the photoconductive layer according to the present invention may comprise either one of the AB type copolymer and the ABA type copolymer or both of the AB type copolymer and the ABA type copolymer.

The ratio of resin (A) to resin (B) used in the present invention is preferably 0.05 to 0.80/0.95 to 0.20, more preferably 0.10 to 0.50/0.90 to 0.50 in terms of a weight ratio of resin (A)/resin (B).

When the weight ratio of resin (A)/resin (B) is less than 0.05, the effect for improving the electrostatic characteristics may reduce. On the other hand, when it is more than 0.80, the film strength of the photoconductive layer may not be sufficiently maintained in some cases (particularly, in case of using as an electrophotographic printing plate precursor).

Furthermore, in the present invention, the binder resin used in the photoconductive layer may contain other resin(s) known for inorganic photoconductive substance in addition to the resin (A) and the resin (B) according to the present invention. However, the amount of other resins descried above should not exceed 30 parts by weight per 100 parts by weight of the total binder resins since, if the amount is more than 30 parts by weight, the effects of the present invention are remarkably reduced.

Representative other resins which can be employed together with the resins (A) and (B) according to the present invention include vinyl chloride-vinyl acetate copolymers, styrene-butadiene copolymers, styrene-methacrylate copolymers, methacrylate copolymers, acrylate copolymers, vinyl acetate copolymers, polyvinyl butyral resins, alkyd resins, silicone resins, epoxy resins, epoxyester resins, and polyester resins.

Specific examples of other resins used are described, for example, in Takaharu Shibata and Jiro Ishiwata, *Kobunshi,* 17, 278 (1968), Harumi Miyamoto and Hidehiko Takei, *Imaging* No. 8, 9 (1973), Koichi Nakamura, *Zetsuen Zairyoyo Binder no Jissai Gijutsu,* Cp. 10, C.M.C. (1985), D. D. Tatt, S. C. Heidecker *Tappi,* 49, No. 10, 439 (1966), E. S. Baltazzi, R. G. Blanclotte, et al., *Photo. Sci. Eng.,* 16, No. 5, 354 (1972), Nguyen Chank Keh, Isamu Shimizu and Eiichi Inoue, *Denshi Shashin Gakkaishi,* 18, No. 2, 28 (1980), JP-B-50-31011, JP-A-53-54027, JP-A-54-20735, JP-A-57-202544 and JP-A- 58-68046.

The total amount of binder resin used in the photoconductive layer according to the present invention is preferably from 10 to 100 parts by weight, more preferably from 15 to 50 parts by weight, per 100 parts by weight of the inorganic photoconductive substance.

When the total amount of binder resin used is less than 10 parts by weight, it may be difficult to maintain the film strength of the photoconductive layer. On the other hand, when it is more than 100 parts by weight, the electrostatic characteristics may decrease and the image forming performance may degrade to result in the formation of poor duplicated image.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide.

As the spectral sensitizing dye according to the present invention, various dyes can be employed individually or as a combination of two or more thereof. Examples of the spectral sensitizing dyes are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging,* 1973, No. 8, 12, C. J. Young et al., *RCA Review,* 15, 469 (1954), Kohei Kiyota et al., *Denkitsushin Gakkai Ronbunshi, J 63-C,* No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50- 90334, JP-A-50-114227, JP-A-53-39130, JP-A-53-82353, U.S. Pat. Nos. 3,052,540 and 4,054,450, and JP-A-57-16456.

The polymethine dyes, such as oxonol dyes, merocyanine dyes, cyanine dyes, and rhodacyanine dyes, include those described, for example, in F. M. Hamer, *The Cyanine Dyes and Related Compounds.* Specific examples include those described, for example, in U.S. Pat. Nos. 3,047,384, 3,110, 591, 3,121,008, 3,125,447, 3,128,179, 3,132,942, and 3,622, 317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near-infrared region to the infrared region, include those described, for example, in JP-A-47-840, JP-A-47-44180, JP-B-51-41061, JP-A-49-5034, JP-A-49-45122, JP-A-57-46245, JP-A-56- 35141, JP-A-57-157254, JP-A-61-26044, JP-A-61-27551, U.S. Pat. Nos. 3,619,154 and 4,175,956, and *Research Disclosure,* 216, 117 to 118 (1982).

The electrophotographic light-sensitive material of the present invention is excellent in that the performance properties thereof are not liable to vary even when various kinds of sensitizing dyes are employed together.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging,* 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka,* Chaps. 4 to 6, Nippon Kagaku Joho K.K. (1986).

The amount of each of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, preferably from 0.05 to 0.5 μm.

If desired, an insulating layer can be provided on the light-sensitive layer of the present invention. When the insulating layer is made to serve for the main purposes for protection and improvement of durability and dark charge retention characteristics of the light-sensitive material, its thickness is relatively small. When the insulating layer is formed to provide the light-sensitive material suitable for application to special electrophotographic processes, its thickness is relatively large, usually ranging from 5 to 70 μm, preferably from 10 to 50 μm.

Charge transporting materials in the above-described laminated light-sensitive material include polyvinylcarbazole, oxazole dyes, pyrazoline dyes, and triphenylmethane dyes. The thickness of the charge transporting layer ranges usually from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin,* 14, No. 1, pp. 2 to 11 (1975), Hiroyuki Moriga, *Nyumon Tokushushi no Kagaku,* Kobunshi Kankokai (1975), and M. F. Hoover, *J. Macromol. Sci. Chem.,* A-4(6), pp. 1327 to 1417 (1970).

The electrophotographic light-sensitive material according to the present invention can be utilized in any known electrophotographic process. Specifically, the light-sensitive material of the present invention is employed in any recording system including a PPC system and a CPC system in combination with any developer including a dry type developer and a liquid developer. In particular, the light-sensitive material is preferably employed in combination with a liquid developer in order to obtain the excellent effect of the present invention since the light-sensitive material is capable of providing faithfully duplicated image of highly accurate original.

Further, a color duplicated image can be produced by using it in combination with a color developer in addition to the formation of black and white image. Reference can be made to methods described, for example, in Kuro Takizawa, *Shashin Kogyo,* 33, 34 (1975) and Masayasu Anzai, *Denshitsushin Gakkai Gijutsu Kenkyu Hokoku,* 77, 17 (1977).

Moreover, the light-sensitive material of the present invention is effective for recent other systems utilizing an electrophotographic process. For instance, the light-sensitive material containing photoconductive zinc oxide as a photoconductive substance is employed as an offset printing plate precursor, and the light-sensitive material containing photoconductive zinc oxide or titanium oxide which does not cause environmental pollution and has good whiteness is employed as a recording material for forming a block copy usable in an offset printing process or a color proof.

BEST MODE FOR CONDUCTING THE INVENTION

The present invention is illustrated in greater detail with reference to the following examples, but the present invention is not to be construed as being limited thereto.

Synthesis examples of the resin (A) are specifically illustrated below.

SYNTHESIS EXAMPLES 1 TO 14 OF RESIN ($A_1$): ($A_1$-1) to ($A_1$-14)

A mixed solution of each monomer corresponding to the repeating unit shown in Table 1 below, 0.02 mols of each chain transfer agent (RSH) and 200 g of toluene was heated to a temperature of 75° C. with stirring under nitrogen gas stream. To the solution was added 2 g of 2,2'-azobisisobutyronitrile (abbreviated as AIBN) to effect a reaction for 4 hours. To the reaction mixture was further added 1.0 g of AIBN, followed by reacting for 4 hours. A weight average molecular weight (Mw) of each of the polymers obtained was in a range of from $5\times 10^3$ to $8\times10^3$. The weight average molecular weight (Mw) was a value measured by the GPC method and calculated in terms of polystyrene.

TABLE 1
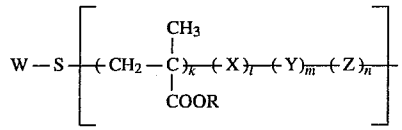
| Synthesis Example of Resin ($A_1$) | Resin ($A_1$) | W— | —R | —X— | —Y— | —Z— | k/l/m/n (weight ratio) |
|---|---|---|---|---|---|---|---|
| 1 | $A_1$-1 | $C_4H_9$— | —$CH_2C_6H_5$— | — | — | —$CH_2$—C(CH$_3$)(COOH)— | 95/0/0/5 |
| 2 | $A_1$-2 | $CH_3OOC(CH_2)_2$— | 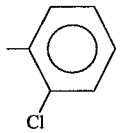 | — | — | —$CH_2$—CH(COOH)— | 96/0/0/4 |
| 3 | $A_1$-3 | " | 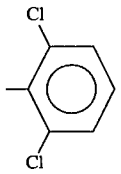 | — | — | —$CH_2$—C(CH$_3$)(COO$(CH_2)_2SO_3H$)— | 97/0/0/3 |
| 4 | $A_1$-4 | " | —$CH_3$ | —$CH_2$—CH($COOCH_3$)— | —$CH_2$—CH( 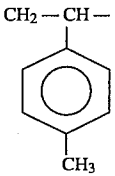 )— | —$CH_2$—CH(COOH)— | 65/20/10/5 |
| 5 | $A_1$-5 | $HOOCCH_2$— | —$CH_2C_6H_5$ | — | — | —$CH_2$—C($CH_3$)(COOH)— | 97.5/0/0/2.5 |

TABLE 1-continued
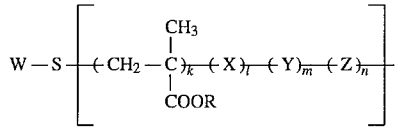
| Synthesis Example of Resin ($A_1$) | Resin ($A_1$) | W— | —R | —X— | —Y— | —Z— | k/l/m/n (weight ratio) |
|---|---|---|---|---|---|---|---|
| 6 | $A_1$-6 | 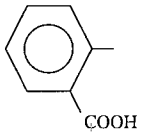 | 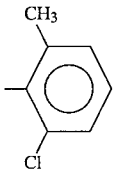 | — | — | 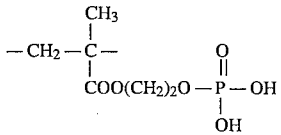 | 98/0/0/2.0 |
| 7 | $A_1$-7 | 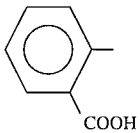 | 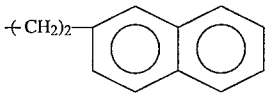 | $-CH_2-CH(COOCH_3)-$ | — | — | 85/15/0/0 |
| 8 | $A_1$-8 | $HO_3S(CH_2)_2-$ | $-CH_2C_6H_5$ | $-CH_2-CH(COOCH_3)-$ | 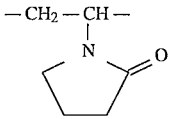 | — | 82/15/3/0 |
| 9 | $A_1$-9 | $HOOC-CH(HOOC-CH_2)-$ | 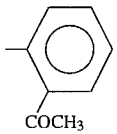 | $-CH_2C(CH_3)(COOCH_2CH_2OCH_3)-$ | — | 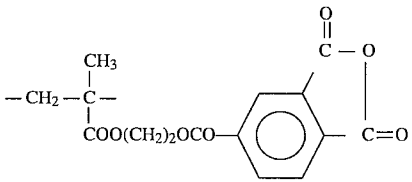 | 90/5/0/5 |

TABLE 1-continued
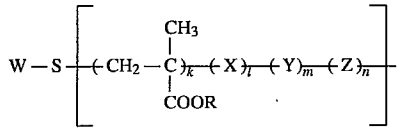
| Synthesis Example of Resin ($A_1$) | Resin ($A_1$) | W— | —R | —X— | —Y— | —Z— | k/l/m/n (weight ratio) |
|---|---|---|---|---|---|---|---|
| 10 | $A_1$-10 | 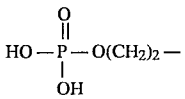 | $-CH_3$ | 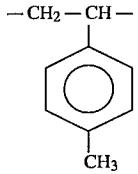 | 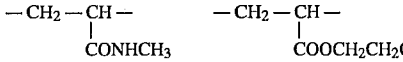 | 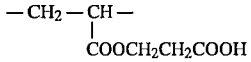 | 73/20/5/2 |
| 11 | $A_1$-11 | $C_4H_9-$ | 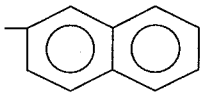 | 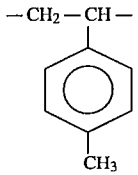 | 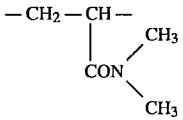 | 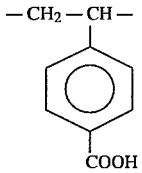 | 74/15/4/7 |
| 12 | $A_1$-12 | " | $-CH_3$ | $-CH_2-CH(COOCH_3)-$ | — | $-CH_2-C(CH_3)(COO(CH_2)_3SO_3H)-$ | 71/25/0/4 |
| 13 | $A_1$-13 | 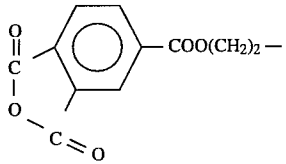 | $-CH_2C_6H_5$ | $-CH_2-CH(COOCH_3)-$ | — | 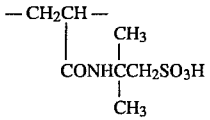 | 87/10/0/3 |

TABLE 1-continued
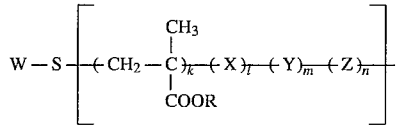
| Synthesis Example of Resin ($A_1$) | Resin ($A_1$) | W— | —R | —X— | —Y— | —Z— | k/l/m/n (weight ratio) |
|---|---|---|---|---|---|---|---|
| 14 | $A_1$-14 | 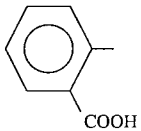 | $-CH_3$ | $-CH_2-CH(COOC_2H_5)-$ | 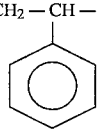 | $-CH_2-C(CH_3)(COOH)-$ | 73/15/10/2 |

SYNTHESIS EXAMPLE 1 OF RESIN ($A_2$): ($A_2$-1)

A mixed solution of 30 g of methyl methacrylate, 16 g of methyl acrylate, 0.5 g of (tetraphenyl porphynato) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 4 g of benzyl methacrylate, after light-irradiating in the same manner as above for 8 hours, 3 g of methanol was added to the reaction mixture followed by stirring for 30 minutes, and the reaction was terminated. Then, Pd-C was added to the reaction mixture, and a catalytic reduction reaction was conducted for one hour at a temperature of 25° C. After removing insoluble substances from the reaction mixture by filtration, the reaction mixture was reprecipitated from 500 ml of petroleum ether and the precipitates formed were collected and dried to obtain 33 g of the polymer having an Mw of $9.3\times10^3$.

Resin $A_2$-1)

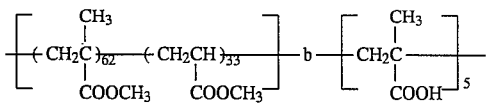

SYNTHESIS EXAMPLE 2 OF RESIN ($A_2$): ($A_2$-2)

A mixed solution of 90 g of 2-chloro-6-methylphenyl methacrylate and 200 g of toluene was sufficiently degassed under nitrogen gas stream and cooled to 0° C. Then, 2.5 g of 1,1-diphenyl-3-methylpentyl lithium was added to the mixture followed by stirring for 6 hours. Further, 10 g of 4-vinylphenyloxytrimethylsilane was added to the mixture and, after stirring the mixture for 6 hours, 3 g of methanol was added to the mixture followed by stirring for 30 minutes. Then, to the reaction mixture was added 10 g of an ethanol solution of 30% hydrogen chloride and, after stirring the mixture at 25° C. for one hour, the mixture was reprecipitated from one liter of petroleum ether. The precipitates thus formed were collected, washed twice with 300 ml of diethyl ether and dried to obtain 58 g of the polymer having an Mw of $7.8\times10^3$.

Resin ($A_2$-2)

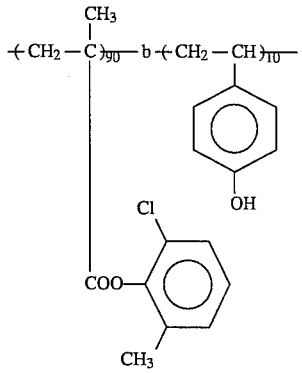

SYNTHESIS EXAMPLE 3 OF RESIN ($A_2$): ($A_2$-3)

A mixture of 95 g of phenyl methacrylate and 4.8 g of benzyl N,N-diethyldithiocarbamate was placed in a vessel under nitrogen gas stream followed by closing the vessel and heated to a temperature of 60° C. The mixture was irradiated with light from a high-pressure mercury lamp of 400 W at a distance of 10 cm through a glass filter for 10 hours to conduct photopolymerization. Then, 5 g of acrylic acid and 180 g of methyl ethyl ketone were added to the mixture and, after replacing the gas in the vessel with nitrogen, the mixture was light-irradiated again for 10 hours. The reaction mixture was reprecipitated from 1.5 liters of hexane and the precipitates formed were collected and dried to obtain 68 g of the polymer having an Mw of $9.5\times10^3$.

Resin ($A_2$-3)

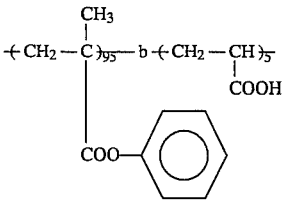

SYNTHESIS EXAMPLES 4 TO 8 OF RESIN ($A_2$): ($A_2$-4) to ($A_2$-8)

Each of the resins ($A_2$) shown in Table 2 below was synthesized in the same manner as described in Synthesis Example 3 of Resin ($A_2$) above, except for using each monomer corresponding to the repeating unit shown in Table 2 below in place of 95 g of phenyl methacrylate and 5 g of acrylic acid, respectively. An Mw of each of the resins was in a range of from $6\times10^3$ to $9.5\times10^3$.

TABLE 2

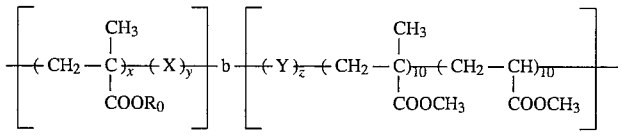

| Synthesis Example of Resin ($A_2$) | Resin ($A_2$) | $-R_0$ | $-X-$ | $-Y-$ | x/y/z (weight ratio) |
|---|---|---|---|---|---|
| 4 | $A_2$-4 | $-CH_3$ | $-CH_2-CH(COOC_2H_5)-$ | $-CH_2-CH(COOH)-$ | 50/25/5 |
| 5 | $A_2$-5 | $-C_2H_5$ | $-CH_2-CH(COOCH_3)-$ | $-CH_2-C(CH_3)(COO(CH_2)_2-O-P(=O)(OH)-OH)-$ | 53/20/7 |
| 6 | $A_2$-6 | 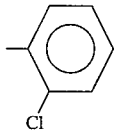 | $-CH_2-CH(COOCH_2C_6H_5)-$ | $-CH_2-C(CH_3)(COOH)-$ | 64/10/6 |
| 7 | $A_2$-7 | 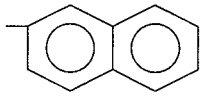 | $-CH_2-CH(COOCH_3)-$ | $-CH_2-CH(COOH)-$ 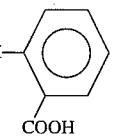 | 53/20/7 |
| 8 | $A_2$-8 | 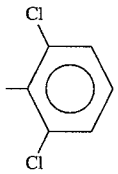 | $-CH_2-CH(COOCH_3)-$ | $-CH_2-CH(COO(CH_2)_2SO_3H)-$ | 54/20/6 |

SYNTHESIS EXAMPLE 9 OF RESIN ($A_2$): ($A_2$-9)

A mixture of 80 g of benzyl methacrylate, 8.5 g of butyl N-ethyl-N-(2-carboxyethyl)dithiocarbamate and 100 g of tetrahydrofuran was placed in a vessel under nitrogen gas stream followed by closing the vessel and heated to a temperature of 50° C. The mixture was irradiated with light under the same condition as described in Synthesis Example 3 of Resin ($A_2$) to react for 10 hours. The reaction mixture

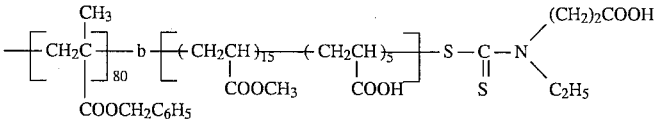

Resin ($A_2$-9)

was reprecipitated from 1.5 liters of methanol and the precipitates were collected and dried. Then, a mixture of 40 g of the polymer thus-obtained, 7.5 g of methyl acrylate, 2.5 g of acrylic acid and 50 g of tetrahydrofuran was dissolved and, after replacing the gas in a vessel with nitrogen, the mixture was subjected to photopolymerization under the same condition as described above. The resulting reaction mixture was reprecipitated from 800 ml of methanol and the precipitates were collected and dried to obtain 33 g of the polymer having an Mw of $9\times10^3$.

SYNTHESIS EXAMPLE 1 OF RESIN ($A_3$): ($A_3$-1)

A mixed solution of 70 g of benzyl methacrylate, 30 g of Macromonomer ($MM_A$-1) having the structure shown below, 150 g of toluene, and 50 g of isopropanol was heated to a temperature of 80° C. under nitrogen gas stream, and 8 g of 4,4'-azobis(2-cyanovaleric acid) (abbreviated as ACV) was added thereto to effect a reaction for 4 hours. To the reaction mixture was further added 1 g of ACV, followed by reacting for 4 hours. The resulting copolymer had an Mw of $9\times10^3$.

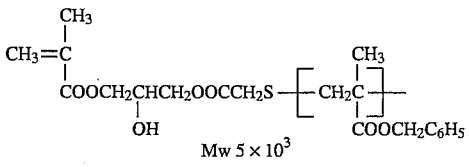

Mw $5\times10^3$ $MM_A$-1

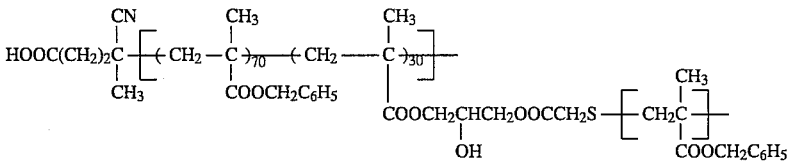

Resin ($A_3$-1)

SYNTHESIS EXAMPLES 2 TO 8 OF RESIN ($A_3$): ($A_3$-2) to ($A_3$-8)

A mixed solution of each of monomers and macromonomers (Mw: $3\times10^3$ to $6\times10^3$) corresponding to the repeating units shown in Table 3 below, 3 g of β-mercaptopropionic acid, and 200 g of toluene was heated to a temperature of 75° C. under nitrogen gas stream. After adding thereto 1.5 g of AIBN, the reaction was carried out for 4 hours. After further adding thereto 0.5 g of AIBN, the reaction was carried out for 4 hours. An Mw of each of the polymers obtained was in a range of from $7\times10^3$ to $1\times10^4$.

TABLE 3

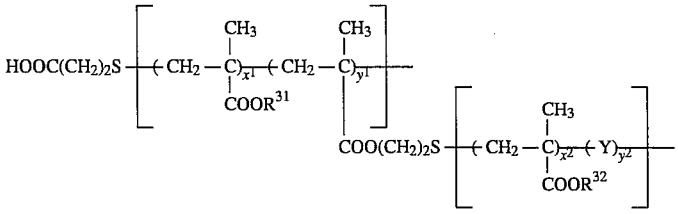

| Synthesis Example of Resin ($A_3$) | Resin ($A_3$) | $R^{31}$ | $x^1/y^1$ (weight ratio) | $-R^{32}$ | $-Y-$ | $x^2/y^2$ (weight ratio) |
|---|---|---|---|---|---|---|
| 2 | $A_3$-2 | $-CH_3$ | 70/30 | $-CH_2C_6H_5$ | — | 100/0 |
| 3 | $A_3$-3 | $-C_6H_5$ | 60/40 | $-CH_2C_6H_5$ | — | 100/0 |
| 4 | $A_3$-4 | $-C_2H_5$ | 75/25 | $-CH_2C_6H_5$ | $-CH_2-CH(COOCH_2C_6H_5)-$ | 60/40 |
| 5 | $A_3$-5 | $-CH_2C_6H_5$ | 80/20 | $-CH_3$ | 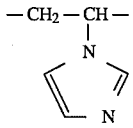 | 95/5 |
| 6 | $A_3$-6 | $-CH_2C_6H_5$ | 60/40 | 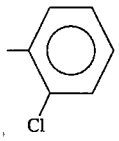 | $-CH_2CH(C\equiv N)-$ | 95/5 |
| 7 | $A_3$-7 | 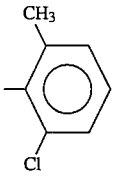 | 80/20 | $-C_6H_5$ | — | 100/0 |

TABLE 3-continued

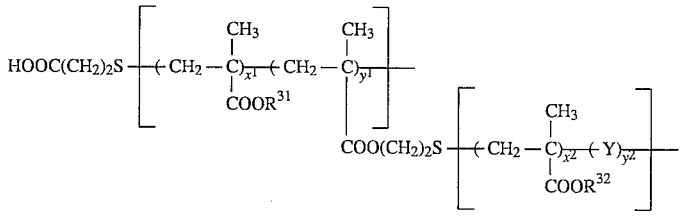

| Synthesis Example of Resin ($A_3$) | Resin ($A_3$) | $R^{31}$ | $x^1/y^1$ (weight ratio) | $-R^{32}$ | $-Y-$ | $x^2/y^2$ (weight ratio) |
|---|---|---|---|---|---|---|
| 8 | $A_3$-8 | 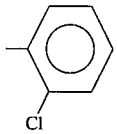 | 75/25 | 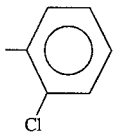 | $-CH_2-CH(COOCH_3)-$ | 80/20 |

SYNTHESIS EXAMPLES 9 TO 16 OF RESIN ($A_3$): ($A_3$-9) to ($A_3$-16)

Each of the polymers shown in Table 4 below was prepared in the same reaction procedure as described in Synthesis Example 1 of Resin ($A_3$) except for using each of monomers and macromonomers corresponding to the components shown in Table 4 below in place of the monomer and macromonomer in Synthesis Example 1 of Resin ($A_3$).

An Mw of each of the polymers was in a range of from $6\times10^3$ to $8\times10^3$.

TABLE 4

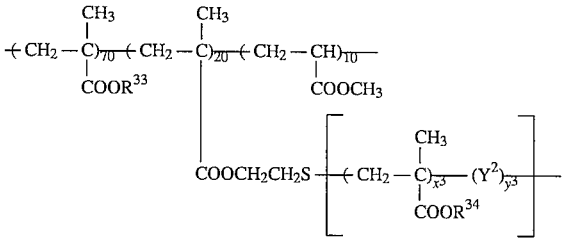

| Synthesis Example of Resin ($A_3$) | Resin ($A_3$) | $-R^{33}$ | $R^{34}$ | $x^3/y^3$ (weight ratio) | $-Y^2-$ |
|---|---|---|---|---|---|
| 9 | $A_3$-9 | $-C_2H_5$ | 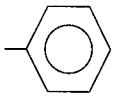 | 90/10 | $-CH_2-CH(COOH)-$ |
| 10 | $A_3$-10 | $-C_3H_7$ | 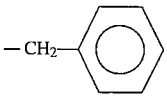 | 85/15 | $-CH_2-C(CH_3)(COO(CH_2)_2OCO(CH_2)_3COOH)-$ |
| 11 | $A_3$-11 | $-C_4H_9$ | 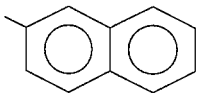 | 90/10 | $-CH_2-C(CH_3)(COO(CH_2)_2O-P(=O)(OH)-OH)-$ |
| 12 | $A_3$-12 | 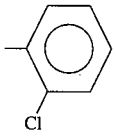 | $-CH_3$ | 90/10 | $-CH_2-CH(COOH_2CH_2COOCH)-$ |

TABLE 4-continued

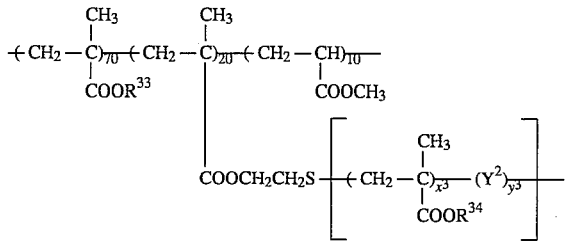

| Synthesis Example of Resin ($A_3$) | Resin ($A_3$) | $-R^{33}$ | $R^{34}$ | $x^3/y^3$ (weight ratio) | $-Y^2-$ |
|---|---|---|---|---|---|
| 13 | $A_3$-13 | 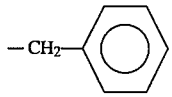 | $-C_2H_5$ | 90/10 | 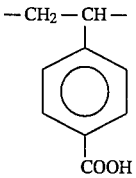 |
| 14 | $A_3$-14 | 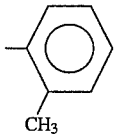 | $-C_4H_9$ | 92/8 | 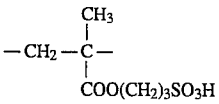 |
| 15 | $A_3$-15 | $-CH_3$ | 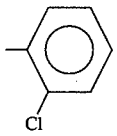 | 93/7 | 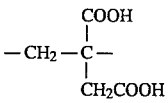 |
| 16 | A-16 | $-CH_3$ | $-C_2H_5$ | 90/10 | 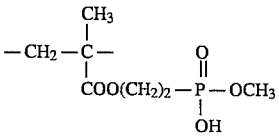 |

SYNTHESIS EXAMPLES 17 TO 22 OF RESIN ($A_3$): ($A_3$-17) to ($A_3$-22)

Each of the polymers shown in Table 5 below was synthesized by a polymerization reaction in the same manner as described in Synthesis Example 2 of Resin ($A_3$) using each of 75 g of monomers, 25 g of macromonomers and 0.04 moles of mercapto compounds corresponding to the components shown in Table 5 below. An Mw of each of the resulting polymers was in a range of from $6\times10^3$ to $1\times10^4$.

TABLE 5
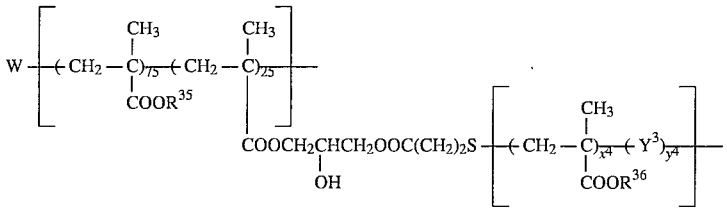
| Synthesis Example of Resin ($A_3$) | Resin ($A_3$) | W— | $R^{35}$ | $R^{36}$ | $x^4/y^4$ (weight ratio) | $-Y^3-$ |
|---|---|---|---|---|---|---|
| 17 | $A_3$-17 | HOOC—$H_2C$—S— | 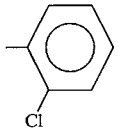 | $-C_2H_5$ | 90/10 | 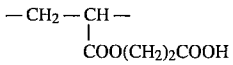 |
| 18 | $A_3$-18 | HOOC—$CH_2$<br>HOOC—CHS— | 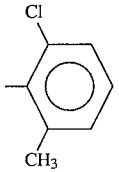 | 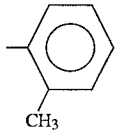 | 85/15 | 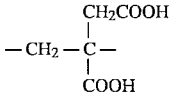 |
| 19 | $A_3$-19 | 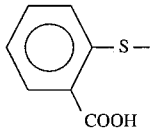 | 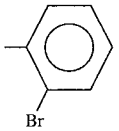 | 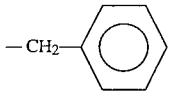 | 90/10 | 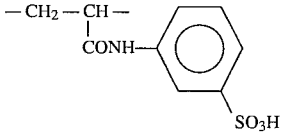 |
| 20 | $A_3$-20 | 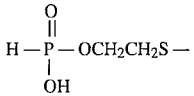 | $-C_2H_5$ | 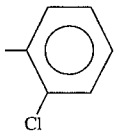 | 90/10 | 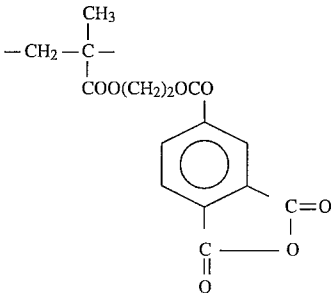 |

TABLE 5-continued
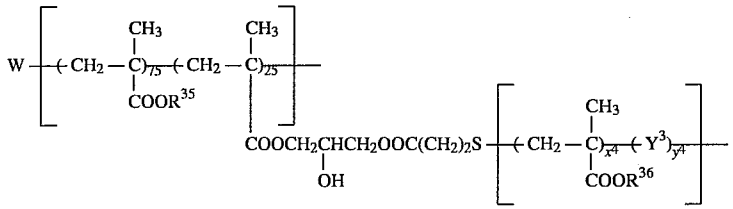
| Synthesis Example of Resin ($A_3$) | Resin ($A_3$) | W — | $R^{35}$ | $R^{36}$ | $x^4/y^4$ (weight ratio) | $-Y^3-$ |
|---|---|---|---|---|---|---|
| 21 | $A_3$-21 | $HO_3SCH_2CH_2S-$ | 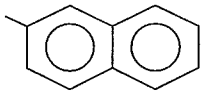 | $-C_4H_9$ | 93/7 | 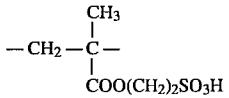 |
| 22 | $A_3$-22 | $HOCH_2CH_2-S-$ | 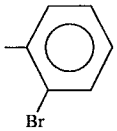 | $-C_2H_5$ | 92/8 | 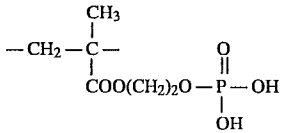 |

SYNTHESIS EXAMPLE 1 OF RESIN ($A_4$): ($A_4$-1)

A mixed solution of 66 g of methyl methacrylate, 30 g of methyl acrylate, 4 g of acrylic acid, 28 g of Initiator (I-1) having the structure shown below and 150 g of tetrahydrofuran was heated to a temperature of 50° C. under nitrogen gas stream.

The solution was irradiated with light from a high-pressure mercury lamp of 400 W at a distance of 10 cm through a glass filter for 10 hours to conduct photopolymerization. The reaction mixture obtained was reprecipitated in one liter of methanol, and the precipitates formed were collected and dried to obtain 72 g of the polymer having an Mw of $1\times10^4$.

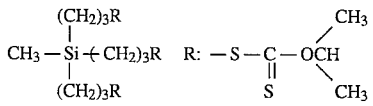

Initiator (I-1)

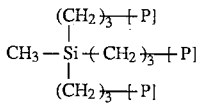

Resin ($A_4$-1)

+P]:

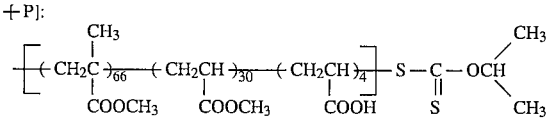

SYNTHESIS EXAMPLES 2 TO 10 OF RESIN ($A_4$): ($A_4$-2) to ($A_4$-10)

Each of the polymers shown in Table 6 below was synthesized under the same condition as described in Synthesis Example 1 of Resin ($A_4$) except for using 36.3 g of Initiator (I-2) having the structure shown below in place of 28 g of Initiator (I-1) and changing the monomers to those corresponding to the repeating units shown in Table 6 below. A yield of each of the resulting polymers was in a range of from 70 to 80 g and an Mw thereof was in a range of from $7\times10^3$ to $1\times10^4$.

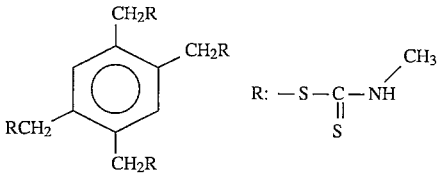

(Initiator (I-2)

TABLE 6

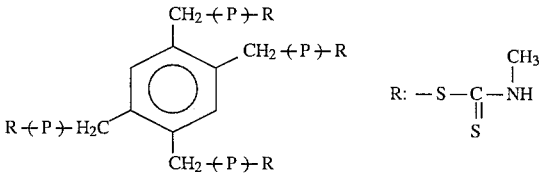

| Synethesis Example of Resin ($A_4$) | ($A_4$) | Component of (P) (weight ratio) |
|---|---|---|
| 2 | ($A_4$-2) | 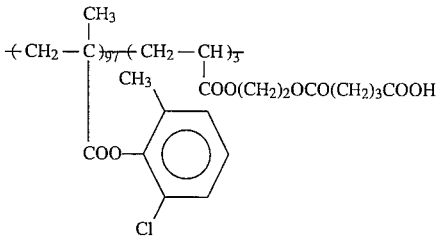 |
| 3 | ($A_4$-3) | 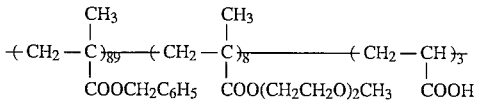 |
| 4 | ($A_4$-4) | 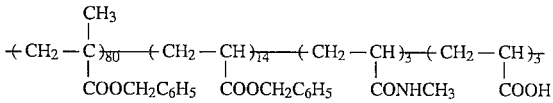 |

TABLE 6-continued
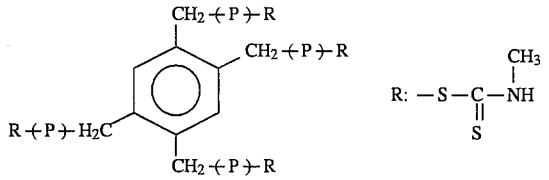
| Synethesis Example of Resin ($A_4$) | ($A_4$) | Component of (P) (weight ratio) |
|---|---|---|
| 5 | ($A_4$-5) | 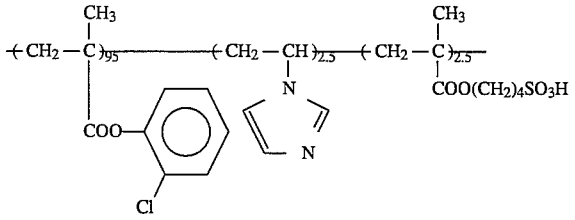 |
| 6 | ($A_4$-6) | 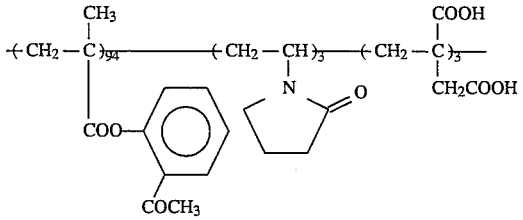 |
| 7 | ($A_4$-7) | 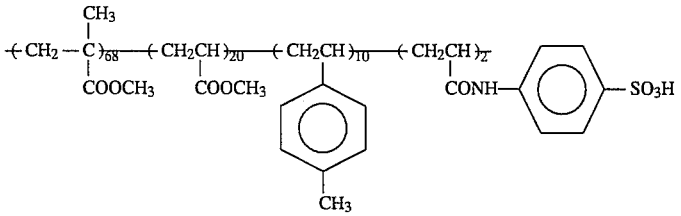 |
| 8 | ($A_4$-8) | 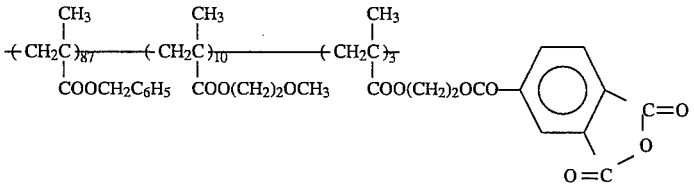 |
| 9 | ($A_4$-9) | 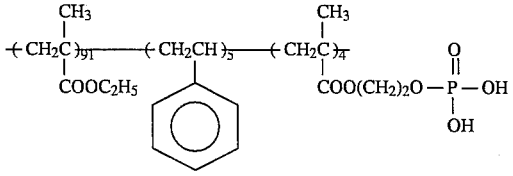 |
| 10 | ($A_4$-10) | 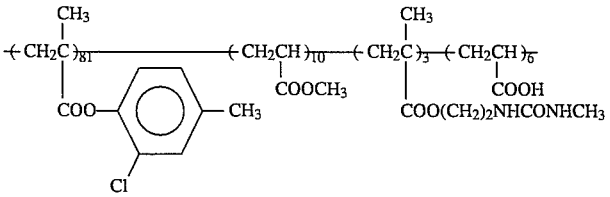 |

SYNTHESIS EXAMPLE 11 OF RESIN ($A_4$): ($A_4$-11)

A mixture of 47.5 g of benzyl methacrylate, 24.8 g of Initiator (I-3) shown below and 70 g of tetrahydrofuran was heated to a temperature of 40° C. under nitrogen gas stream. The solution was irradiated with light from a high-pressure mercury lamp of 400 W at a distance of 10 cm through a glass filter, and a photopolymerization reaction was conducted for 10 hours.

Initiator (I-3)

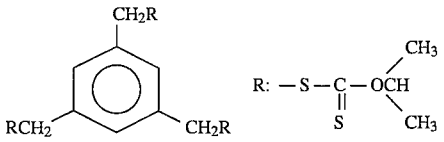

To the reaction mixture was added a mixed solution of 2.5 g of methacrylic acid and 5 g of tetrahydrofuran, and the mixture was further irradiated with light in the same manner as above for 10 hours at a temperature of 40° C. under nitrogen gas stream. The reaction mixture was reprecipitated in 800 ml of a solvent mixture of water and methanol (2:1), and the precipitates formed were collected and dried. The yield of the resulting polymer was 38 g and an Mw thereof was $8.5\times10^3$.

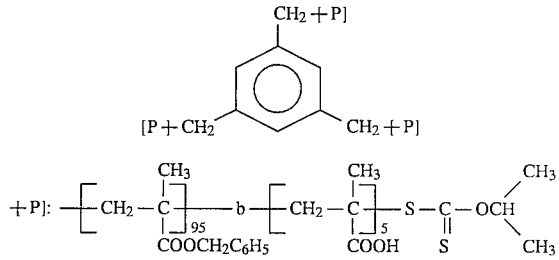

SYNTHESIS EXAMPLES 12 TO 17 OF RESIN ($A_4$): ($A_4$-12) to ($A_4$-17)

A mixed solution of 30 g of 2-chlorophenyl methacrylate, 0.02 moles of Initiator shown in Table 7 below and 50 g of tetrahydrofuran was subjected to light irradiation for 8 hours in the same manner as described in Synthesis Example 1 of Resin ($A_4$). To the reaction mixture was added a mixed solution of 9 g of methyl methacrylate, 9 g of methyl acrylate, 2 g of methacrylic acid and 10 g of tetrahydrofuran, followed by reacting in the same manner as described in Synthesis Example 1 of Resin ($A_4$). An Mw of each of the resulting polymers was in a range of from $5\times10^3$ to $9\times10^3$.

TABLE 7
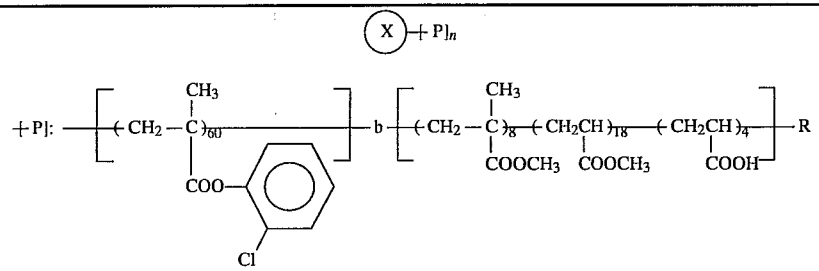
| Synthesis Example of Resin ($A_4$) | Resin ($A_4$) | Initiator (I) | —R | X |
|---|---|---|---|---|
| 12 | ($A_4$-12) | 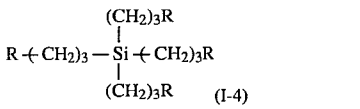 (I-4) | 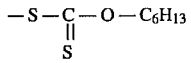 | 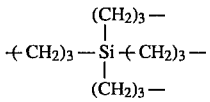 |
| 13 | ($A_4$-13) | 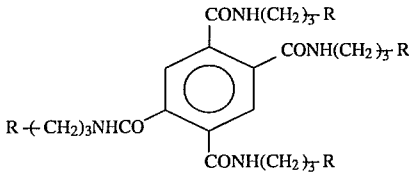 (I-5) | 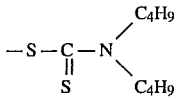 | 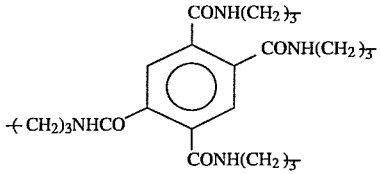 |
| 14 | ($A_4$-14) | 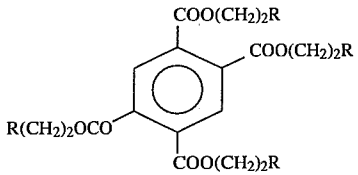 (I-6) | 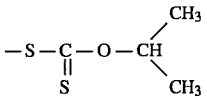 | 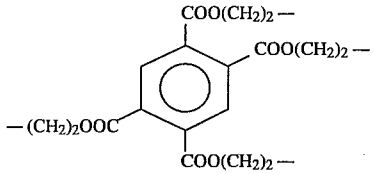 |

TABLE 7-continued
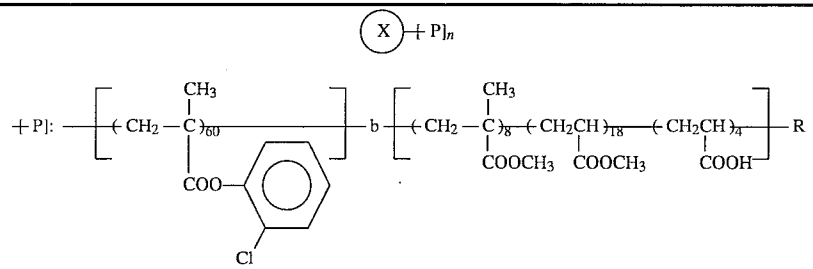
| Synthesis Example of Resin ($A_4$) | Resin ($A_4$) | Initiator (I) | —R | X |
|---|---|---|---|---|
| 15 | ($A_4$-15) | 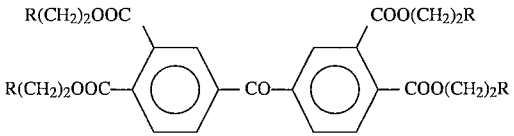 (I-7) | 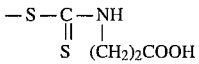 | 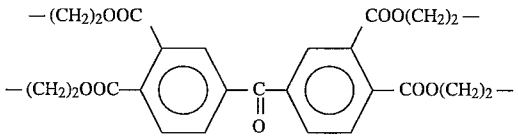 |
| 16 | ($A_4$-16) | 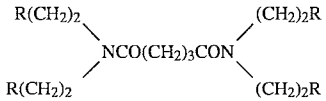 (I-8) | 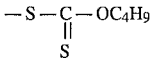 | 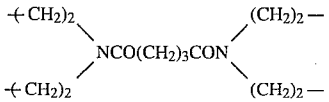 |
| 17 | ($A_4$-17) | 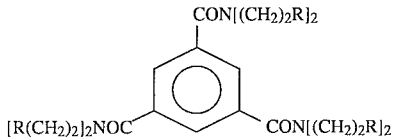 (I-9) | 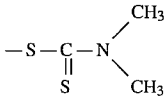 | 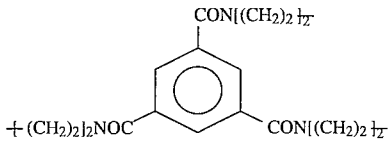 |

Synthesis examples of the resin (B) are specifically illustrated below.

SYNTHESIS EXAMPLE 1 OF MACROMONOMER ($M_B$): ($M_B$-1)

A mixed solution of 10 g of triphenylmethyl methacrylate, and 100 g of toluene was sufficiently degassed under nitrogen gas stream and cooled to −20° C. Then, 0.02 g of 1,1-diphenylbutyl lithium was added to the mixture, and the reaction was conducted for 10 hours. Separately, a mixed solution of 90 g of ethyl methacrylate and 100 g of toluene was sufficiently degassed under nitrogen gas stream and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated. The temperature of the reaction solution obtained was raised to 25° C. under stirring, 6 g of 2-hydroxyethyl methacrylate was added thereto, then a mixed solution of 10 g of dicyclohexylcarbodiimide, 0.2 g of 4-N,N-dimethylaminopyridine and 30 g of methylene chloride was added dropwise thereto over a period of 30 minutes, and the mixture was stirred for 3 hours.

After removing the insoluble substances from the reaction mixture by filtration, 10 ml of an ethanol solution of 30% by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether. The precipitates thus formed were collected and dried under reduced pressure to obtain 56 g of the polymer having an Mw of $6.5\times10^3$.

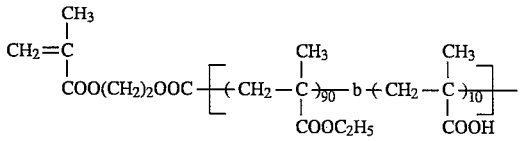

($M_B$-1)

—b—: a bond connecting blocks

Then, Pd-C was added to the reaction mixture, and a catalytic reduction reaction was conducted for one hour at a temperature of 25° C. After removing insoluble substances from the reaction mixture by filtration, the reaction mixture was reprecipitated from 500 ml of petroleum ether and the precipitates thus formed were collected and dried to obtain 33 g of the polymer having an Mw of $7\times10^3$.

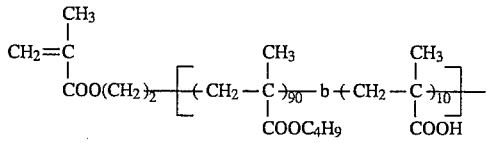

($M_B$-2)

SYNTHESIS EXAMPLE 3 OF MACROMONOMER $M_B$: ($M_B$-3)

A mixture of 60 g of methyl methacrylate, 20 g of methyl acrylate, 6.3 g of benzyl N-hydroxyethyl-N-ethyldithiocarbamate and 80 g of tetrahydrofuran was placed in a vessel under nitrogen gas stream followed by closing the vessel and heated to a temperature of 60° C. The mixture was irradiated with light from a high-pressure mercury lamp of 400 W at a distance of 10 cm through a glass filter for 10 hours to conduct photopolymerization. Then, 10 g of acrylic acid, 10 g of methyl methacrylate and 40 g of tetrahydrofuran were added to the mixture and, after replacing the gas in the vessel with nitrogen, the mixture was light-irradiated again for 10 hours.

To the reaction mixture were added dropwise 6 g of 2-isocyanatoethyl methacrylate and 0.01 g of tetrabutoxy titanate at a temperature of 30° C. over a period of one hour and the mixture was stirred for 4 hours. The resulting reaction mixture was reprecipitated from 1.5 liters of hexane and the precipitates thus formed were collected and dried to obtain 68 g of the polymer having an Mw of $8.0\times10^3$.

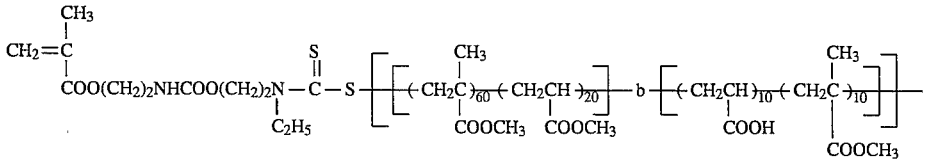

($M_B$-3)

SYNTHESIS EXAMPLE 2 OF MACROMONOMER $M_B$: ($M_B$-2)

A mixed solution of 5 g of benzyl methacrylate, 0.01 g of (tetraphenyl porphynate) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 18 hours. To the mixture was further added 45 g of butyl methacrylate, after similarly light-irradiating for 20 hours, 8 g of 2-bromoethyl methacrylate was added to the reaction mixture followed by stirring for 3 minutes, then the reaction was terminated.

SYNTHESIS EXAMPLE 4 OF MACROMONOMER $M_B$: ($M_B$-4)

A mixed solution of 66.5 g of methyl methacrylate, 28.5 g of methyl acrylate, 6.8 g of trimethylsilyl methacrylate, 2.5 g of thioglycolic acid, and 200 g of tetrahydrofuran was heated to a temperature of 75° C. under nitrogen gas stream. To the mixture was added 0.8 g of 2,2'-azobisisobutyronitrile (abbreviated as AIBN) to effect reaction for 4 hours, and further was added 0.3 g of AIBN, followed by reacting for 4 hours. After cooling the reaction mixture to a temperature of 25° C., 7.0 g of 2-hydroxyethyl methacrylate was added thereto and then a mixed solution of 10.0 g of dicyclohexylcarbodiimide (abbreviated as DCC), 0.1 g of 4-N,N-dimethylaminopyridine and 20 g of methylene chloride was added dropwise thereto over a period of one hour with stirring, followed by further reacting for 4 hours.

To the reaction mixture was added 10 g of an 85% aqueous solution of formic acid, followed by stirring for 2 hours, and the precipitates were separated by suction filtration. The filtrate was reprecipitated from one liter of methanol and the resulting precipitates were collected by decantation. The precipitates were dissolved in 300 g of toluene and the insoluble substances were separated by filtration. The filtrate was reprecipitated from one liter of a solvent mixture of n-hexane/ethanol (3/14) and the resulting precipitates were collected and dried under reduced pressure to obtain 58 g of the polymer having an Mw of $7\times10^3$.

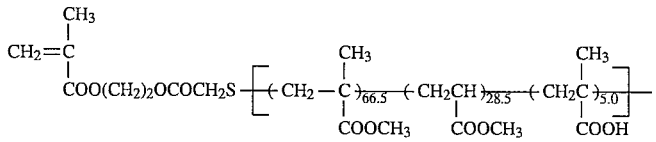

($M_B$-4)

SYNTHESIS EXAMPLE 5 OF MACROMONOMER $M_B$: ($M_B$-5)

A mixed solution of 96 g of ethyl methacrylate, 4 g of 3-sulfopropyl methacrylate, 3 g of 2-mercaptoethanol, 150 g of tetrahydrofuran, and 50 g of methanol was heated to a temperature of 65° C. under nitrogen gas stream with stirring. To the mixture was added 0.8 g of 2,2'-azobisisovaleronitrile (abbreviated AIVN) to effect reaction for 4 hours, and further was added 0.5 g of AIVN, followed by reacting for 4 hours. After cooling, the mixture was reprecipitated from one liter of methanol and the resulting precipitates were collected and dried under reduced pressure to obtain 63 g of a polymer.

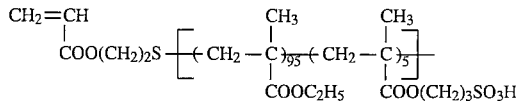

($M_B$-5)

SYNTHESIS EXAMPLE 1 OF RESIN (B): (B-1)

A mixed solution of 54 g of methyl methacrylate, 26 g of methyl acrylate, 1.7 g of n-butyl N,N-diethyldithiocarbamate and 80 g of tetrahydrofuran was placed in a vessel under nitrogen gas stream followed by closing the vessel and heated to a temperature of 50° C. The mixture irradiated with light from a high-pressure mercury lamp of 400 W at a distance of 10 cm through a glass filter for 8 hours to conduct photopolymerization. Then, 10 g of methyl acrylate, 10 g of Macromonomer ($M_B$-1) and 30 g of tetrahydrofuran were added to the mixture and, after replacing the gas in the vessel with nitrogen, the mixture was light-irradiated again for 18 hours. The reaction product was reprecipitated from one liter of methanol and the resulting precipitates were collected by filtration and dried under reduced pressure to obtain 75 g of the polymer having an Mw of $8.5\times10^4$.

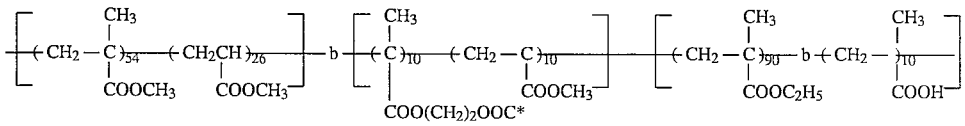

Then, 50 g of the polymer was dissolved in 100 g of tetrahydrofuran and to the solution was added 5.5 g of acrylic acid, followed by adjusting at a temperature of 25° C. with stirring. A mixed solution of 15.9 g of DCC, 0.6 g of 4-(N,N-dimethylamino)pyridine, and 20 g of methylene chloride was added dropwise thereto over a period of one hour, followed by further stirring for 3 hours. To the mixture was added 8 g of an 85% aqueous solution of formic acid, followed by stirring for one hour, and the insoluble substrates were separated by suction filtration. The filtrate was reprecipitated from 700 ml of a solvent mixture of hexane/ethanol (3/1) and the resulting precipitates were collected and dried under reduced pressure to obtain the polymer having an Mw of $6\times10^3$.

SYNTHESIS EXAMPLE 2 OF RESIN (B): (B-2)

A mixed solution of 75 g of methyl methacrylate, 25 g of Macromonomer ($M_B$-2), 5.4 g of Initiator (I-10) having the structure shown below, and 105.4 g of tetrahydrofuran was placed in a vessel under nitrogen gas stream followed by closing the vessel. The mixture was subjected to photopolymerization under the same condition as described in Synthesis Example 1 of Resin (B) for 12 hours at a temperature of 50° C.

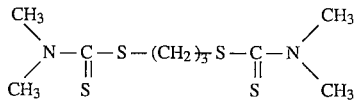

(Initiator (I-10)

A mixed solution of 20 g (10 g as solid basis) of the polymer described above, 58 g of methyl methacrylate, 19.5 g of methyl acrylate, 2.5 g of N-vinylpyrrolidone and 100 g of tetrahydrofuran was placed in a vessel under nitrogen gas stream followed by closing the vessel. The mixture was subjected to photopolymerization under the same reaction condition as described above at a temperature of 50° C. for 10 hours. The reaction product was reprecipitated from one liter of methanol and the resulting precipitates were collected by filtration and dried under reduced pressure to obtain 80 g of the polymer having an Mw of $1.2\times10^5$.

nol and the resulting precipitates were collected by filtration and dried under reduced pressure to obtain 76 g of the polymer having an Mw of $1\times10^5$.

Resin (B-2)

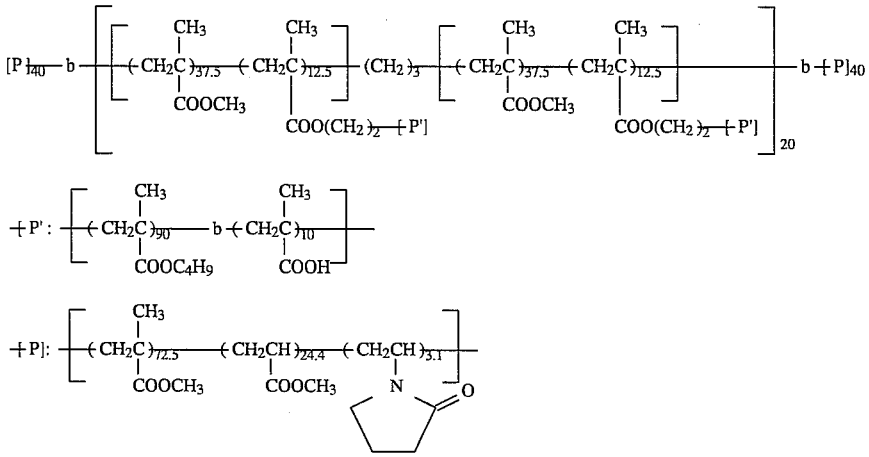

Resin (B-3)

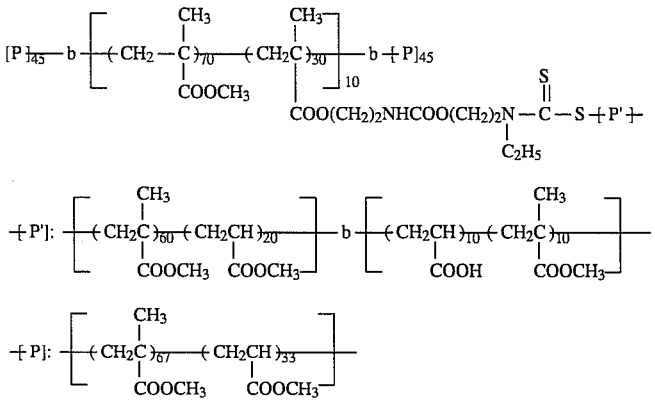

SYNTHESIS EXAMPLE 3 OF RESIN (B): (B-3)

A mixed solution of 70 g of methyl methacrylate, 30 g of Macromonomer ($M_B$-3), 4.3 g of Initiator (I-11) having the structure shown below, and 104.3 g of tetrahydrofuran was subjected to photopolymerization under the same condition as described in Synthesis Example 2 of Resin (B-2).

Initiator (I-11)

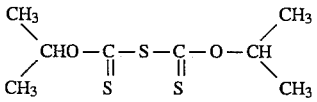

A mixed solution of 10 g (5 g as solid basis) of the polymer described above, 60.3 g of methyl methacrylate, 29.7 g of methyl acrylate and 100 g of tetrahydrofuran was subjected to photopolymerization in the same manner as described in Synthesis Example 2 of Resin (B-2). The reaction product was reprecipitated from one liter of methanol and the resulting precipitates were collected and dried to obtain 152 g of the polymer

SYNTHESIS EXAMPLE 4 OF RESIN (B): (B-4)

A mixed solution of 67 g of methyl methacrylate, 33 g of butyl methacrylate, 0.8 g of benzyl N,N-dimethyldithiocarbamate and 100 g of tetrahydrofuran was light-irradiated under the same condition as described in Synthesis Example 1 of Resin (B) to conduct photopolymerization. The-resulting polymer solution was mixed with a mixed solution of 24 g of methyl methacrylate, 6 g of Macromonomer ($M_B$-5) and 30 g of tetrahydrofuran and the mixture was subjected to photopolymerization under the same condition as described above.

The resulting polymer solution was mixed with a mixed solution of 42 g of methyl methacrylate, 18 g of ethyl acrylate and 60 g of tetrahydrofuran and the mixture was subjected to photopolymerization under the same condition as described above. The reaction product was reprecipitated from one liter of methanol and the resulting precipitates were collected and dried to obtain 152 g of the polymer having an Mw of $1.1\times10^5$.
Resin (B-4)
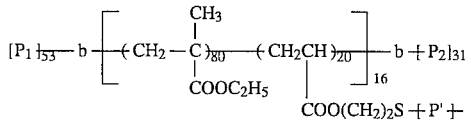
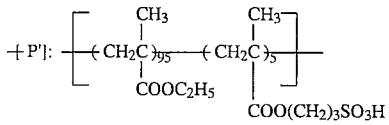
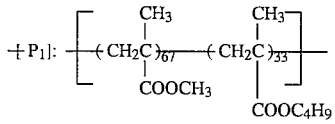
-continued
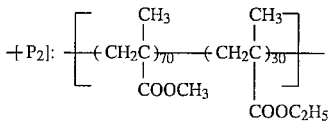
SYNTHESIS EXAMPLES 5 TO 11 OF RESIN (B): (B-5) to (B-11)
Each of the polymers shown in Table 8 below was synthesized in the same manner as described in Synthesis Example 1 of Resin (B). An Mw of each of the polymers obtained was in a range of from $8\times10^4$ to $1\times10^5$.
TABLE 8
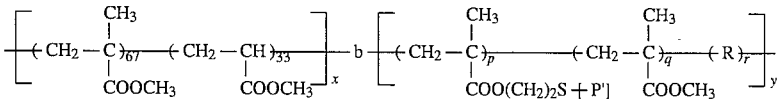
| (B) | x/y | —[P'] | —R— | p/q/r |
|---|---|---|---|---|
| B-5 | 85/15 | 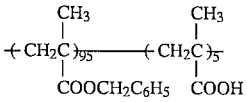 | 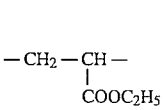 | 20/55/25 |
| B-6 | 90/10 | 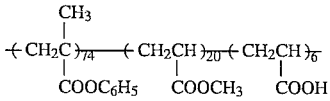 | 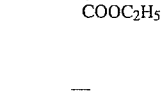 | 5/55/20 |
| B-7 | 80/20 | 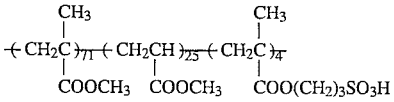 | — | 20/80/0 |
| B-8 | 85/15 | 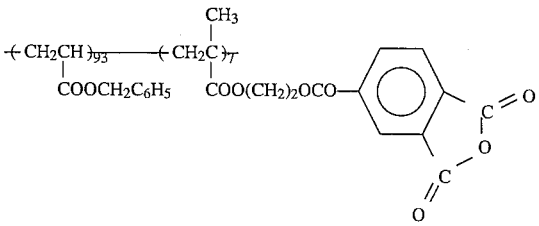 | — | 15/85/0 |
| B-9 | 95/5 | 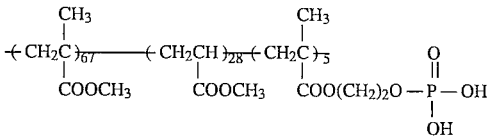 | 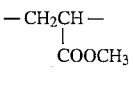 | 20/65/15 |
| B-10 | 95/5 | 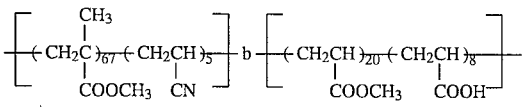 | 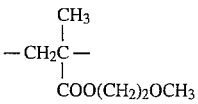 | 15/77/8 |

TABLE 8-continued
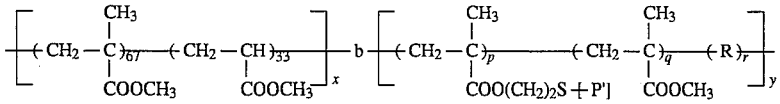
| (B) | x/y | —[P'] | —R— | p/q/r |
|---|---|---|---|---|
| B-11 | 93/7 | 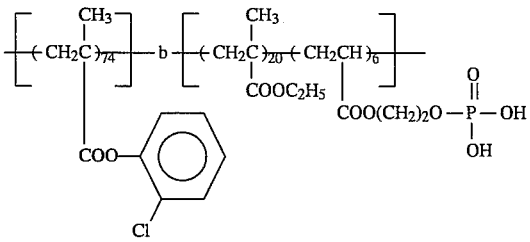 | — | 10/90/0 |
SYNTHESIS EXAMPLES 12 TO 36 OF RESIN (B): (B-12) to (B-36)
Resins (B) shown in Tables 9 and 10 below were synthesized in the same manner as described in Synthesis Example 3 of Resin (B). An Mw of each of the resins (B) was in a range of from $9\times10^4$ to $2\times10^5$.

TABLE 9
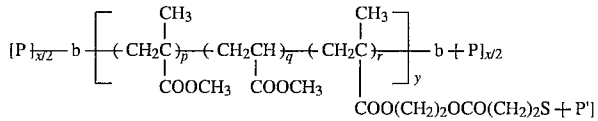
| (B) | x/y | —[P] | —[P'] | p/q/r |
|---|---|---|---|---|
| B-12 | 90/10 | 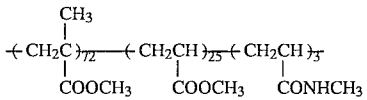 | 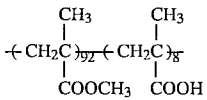 | 62/18/20 |
| B-13 | 97/3 | 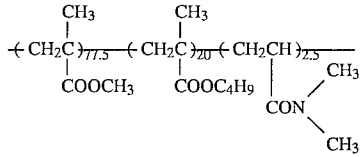 | 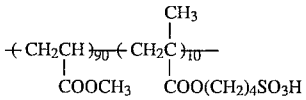 | 65/10/25 |
| B-14 | 95/5 | 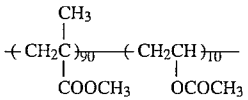 | 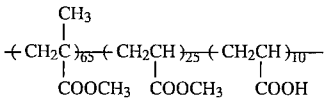 | 65/20/15 |
| B-15 | 96/4 | 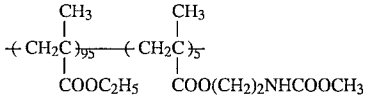 | 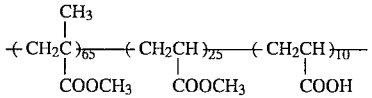 | 58/22/20 |
| B-16 | 92/8 | 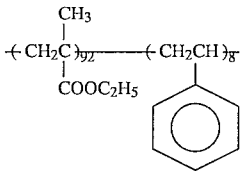 | 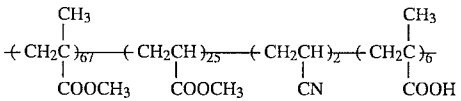 | 65/20/15 |
| B-17 | 90/10 | 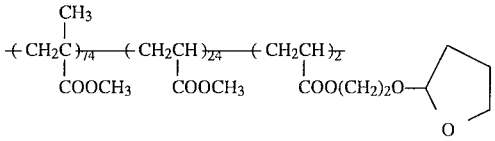 | " | 64/18/18 |

TABLE 9-continued
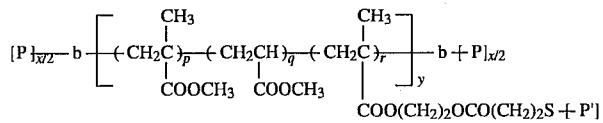
| (B) | x/y | —[P] | —[P'] | p/q/r |
|---|---|---|---|---|
| B-18 | 90/10 | 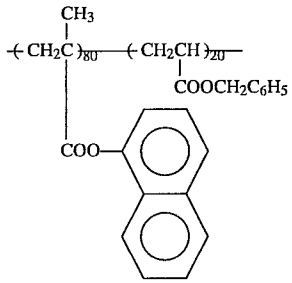 | " | 55/25/20 |
| B-19 | 92/8 | 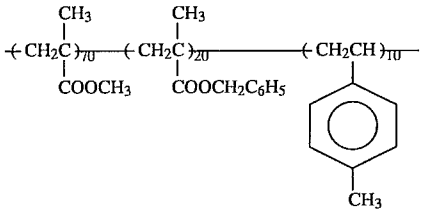 | 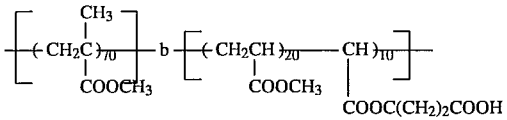 | 65/20/15 |
| B-20 | 90/10 | 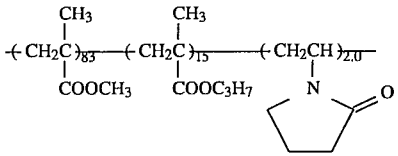 | 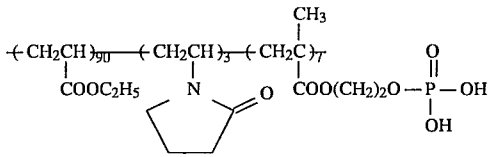 | 90/0/10 |
| B-21 | 90/10 | 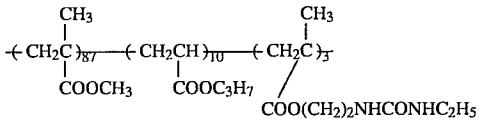 | 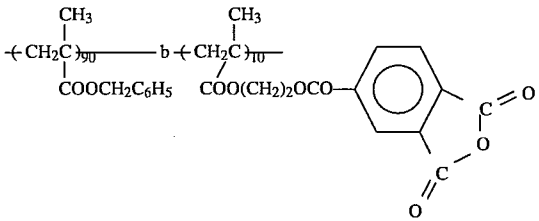 | 77/8/15 |

TABLE 9-continued
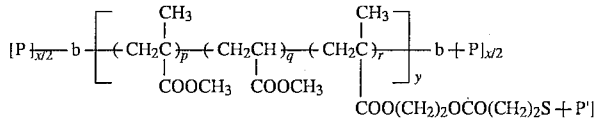
| (B) | x/y | —[P] | —[P'] | p/q/r |
|---|---|---|---|---|
| B-22 | 95/5 | 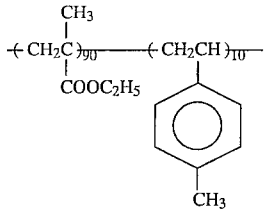 | 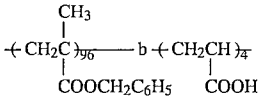 | 64/26/10 |

TABLE 10
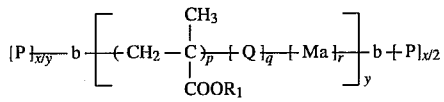
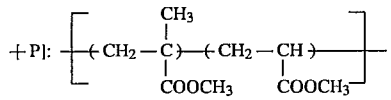
| (B) | x/y | $-R_1$ | $-Q-$ | $-Ma-$ | p/q/r |
|---|---|---|---|---|---|
| B-23 | 96/4 | $-CH_3$ | $-CH_2CH(COOC_2H_5)-$ | 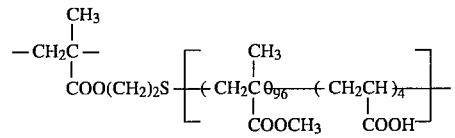 | 75/10/15 |
| B-24 | 95/5 | $-C_2H_5$ | $-CH_2CH(COOCH_3)-$ | 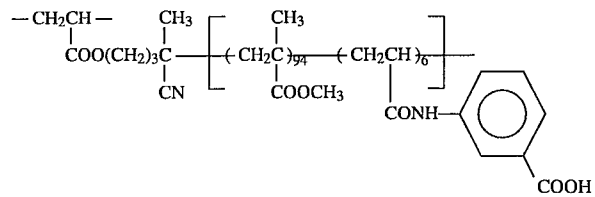 | 80/10/10 |
| B-25 | 90/10 | $-C_4H_9$ | — | 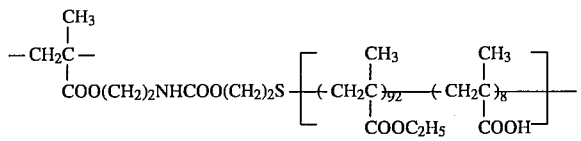 | 90/0/8 |
| B-26 | 85/15 | $-CH_3$ | $-CH_2CH(COOCH_3)-$ | 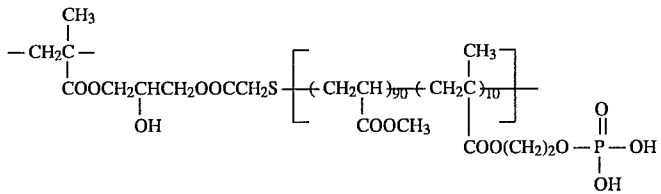 | 65/30/5 |

TABLE 10-continued
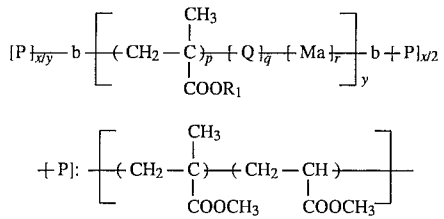
| (B) | x/y | $-R_1$ | $-Q-$ | $-Ma-$ | p/q/r |
|---|---|---|---|---|---|
| B-27 | 90/10 | $-CH_2C_6H_5$ | 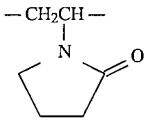 | 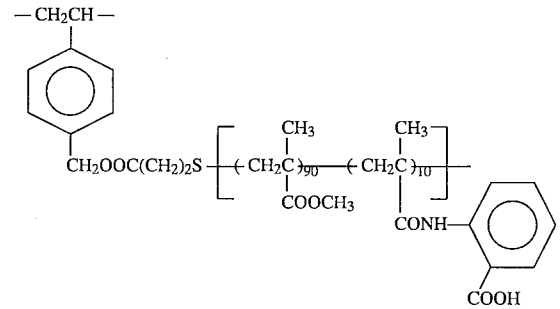 | 83/2/15 |
| B-28 | 90/10 | — | 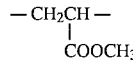 | 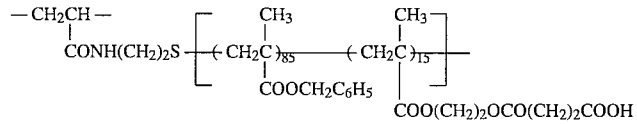 | 0/90/10 |
| B-29 | 90/10 | $-CH_3$ | 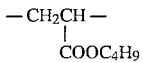 | 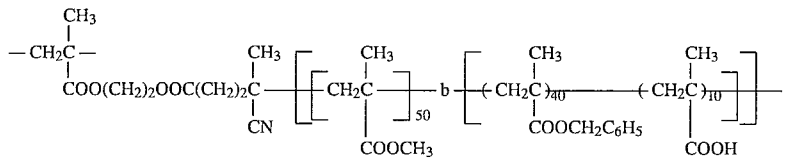 | 70/10/20 |
| B-30 | 92/8 | $-CH_2C_6H_5$ | 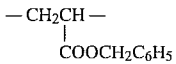 | 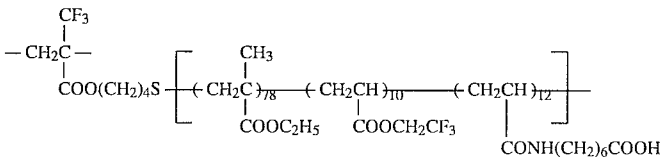 | 75/15/15 |

TABLE 10-continued
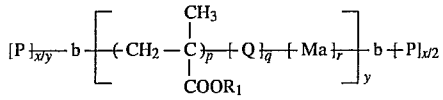
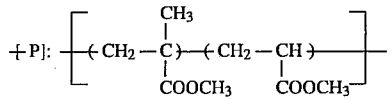
| (B) | x/y | $-R_1$ | $-Q-$ | $-Ma-$ | p/q/r |
|---|---|---|---|---|---|
| B-31 | 93/7 | $-C_6H_5$ | — | 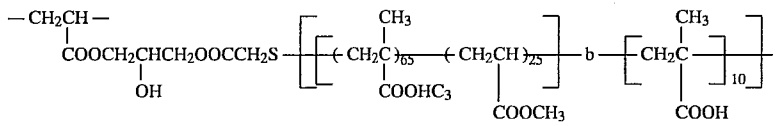 | 75/0/25 |
| B-32 | 90/10 | $-C_2H_5$ | 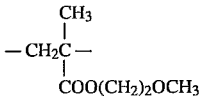 | 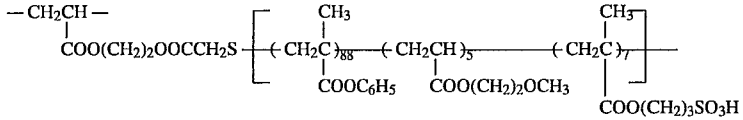 | 80/8/12 |
| B-33 | 88/12 | $-CH_3$ | 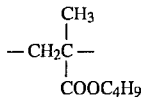 | " | 65/15/20 |
| B-34 | 85/15 | 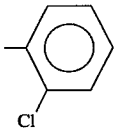 | 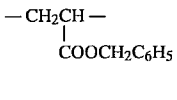 | 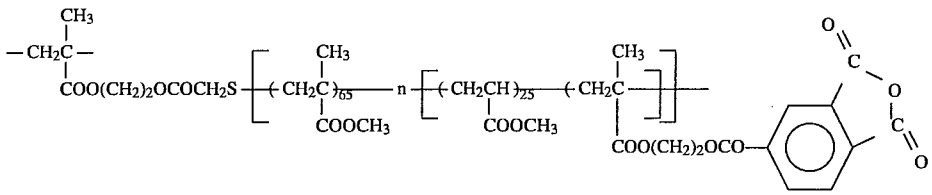 | 70/5/25 |
| B-35 | 90/10 | $-C_2H_5$ | — | 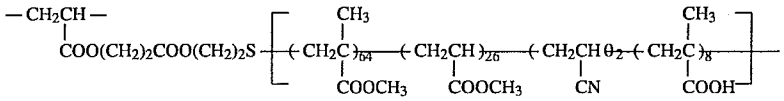 | 80/0/20 |

TABLE 10-continued
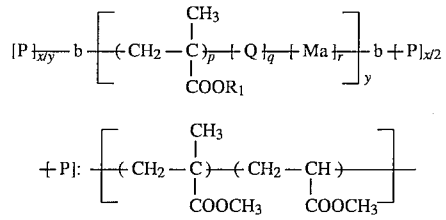
| (B) | x/y | $-R_1$ | $-Q-$ | $-Ma-$ | p/q/r |
|---|---|---|---|---|---|
| B-36 | 90/10 | 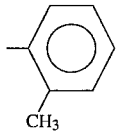 | — | " | 80/0/20 |

EXAMPLE 1

A mixture of 6 g (solid basis) of Resin ($A_1$-6), 34 g (solid basis) of Resin (B-2), 200 g of photoconductive zinc oxide, 0.018 g of Dye (I) having the structure shown below, 0.15 g of phthalic anhydride and 300 g of toluene was dispersed by a homogenizer (manufactured by Nippon Seiki K.K.) at a rotation of $6\times10^3$ r.p.m. for 7 minutes to prepare a coating composition for a light-sensitive layer. The coating composition was coated on paper, which has been subjected to electrically conductive treatment, by a wire bar at a dry coverage of 25 g/m$^2$, followed by drying at 110° C. for 10 seconds. The coated material was then allowed to stand in a dark place at 20° C. and 65% RH for 24 hours to prepare an electrophotographic light-sensitive material (hereinafter simply referred to as a light-sensitive material sometimes).

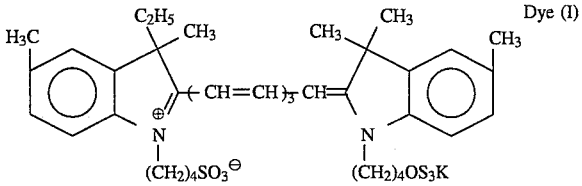

COMPARATIVE EXAMPLE 1

An electrophotographic light-sensitive material was prepared in the same manner as in Example 1, except for using 34 g of Resin (R-1) having the structure shown below in place of 34 g of Resin (B-2) used in Example 1.

Comparative Resin (R-1)

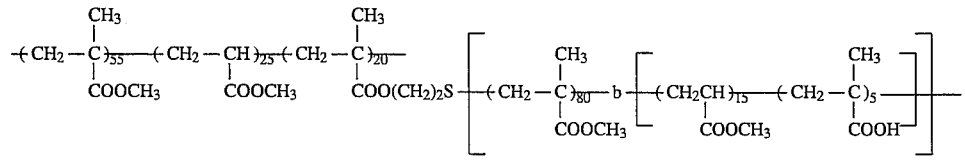

COMPARATIVE EXAMPLE 2

An electrophotographic light-sensitive material was prepared in the same manner as in Example 1, except for using 34 g of Resin (R-2) having the structure shown below in place of 34 g of Resin (B-2) used in Example 1.

Comparative Resin (R-2)

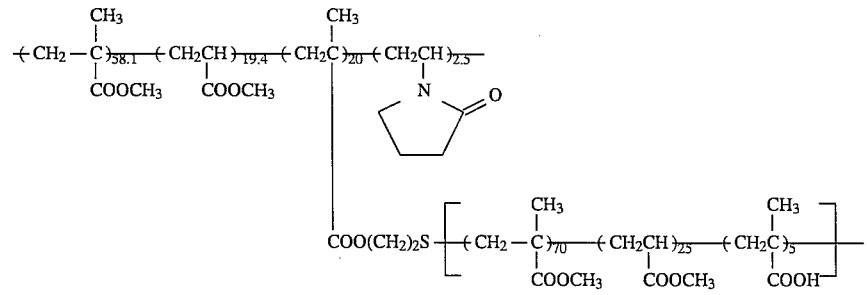

With each of the light-sensitive materials thus prepared, smoothness of photoconductive layer, image forming performance, anti-abrasion property and printing property were evaluated. The results obtained are shown in Table 11 below.

TABLE 11

| | Example 1 | Comparative Example 1 | Comparative Example 2 |
|---|---|---|---|
| Smoothness of Photoconductive *1) Layer (sec/cc) | 180 | 170 | 180 |
| Image Forming *2) Performance | | | |
| I (20° C., 65% RH) | Very good | Very good | Very good |
| II (30° C., 80% RH) | Very good | Good | Slight unevenness in half tone area |
| III (15° C., 30% RH) | Very good | Very slight unevenness in half tone area | Slight unevenness in half tone area |
| Anti-Abrasion Property *3) | Very good | Background stain, slight scratches of letters | Severe background stain, Sever scratches of letters |
| Printing Property *4) | 10,000 prints | Background stain from the start of printing | Background stain from the start of printing |

The evaluation of each item shown in Table 11 was conducted in the following manner.

*1) Smoothness of Photoconductive Layer

The smoothness (sec/cc) of the light-sensitive material was measured using a Beck's smoothness test machine (manufactured by Kumagaya Riko K.K.) under an air volume condition of 1 cc.

*2.) Image Forming Performance

After the light-sensitive material was allowed to stand for one day under the ambient condition shown below, the light-sensitive material was charged to −6 kV and exposed to light emitted from a gallium-aluminum-arsenic semiconductor laser (oscillation wavelength: 780 nm; output: 2.8 mW) at an exposure amount of 64 erg/cm$^2$ (on the surface of the light-sensitive material) at a pitch of 25 μm and a scanning speed of 300 m/sec. The thus formed electrostatic latent image was developed with a liquid developer ("ELP-T" manufactured by Fuji Photo Film Co., Ltd.), washed with a rinse liquid of isoparaffinic solvent ("Isopar G" manufactured by Esso Chemical K.K.) and fixed. The duplicated image obtained was visually evaluated for fog and image quality. The ambient condition at the time of image formation was 20° C. and 65% RH (I), 30° C. and 80% RH (II) or 15° C. and 30% RH (III).

*3) Anti-Abrasion Property

On the surface of one sheet of the light-sensitive material was superposed another sheet thereof so that the light-sensitive layer was in contact with the back surface of the light-sensitive material and then, a weight of 75 g was placed on the sheets. The upper light-sensitive material was gradually pulled horizontally. The light-sensitive material whose photoconductive layer had been rubbed was subjected to plate making (i.e., formation of duplicated image) in the same manner as described in *2) above, and the image formed and the non-image area in the portion which had been rubbed under the weight were visually evaluated. The ambient condition at the time of image formation was 20° C. and 65% RH (I).

*4) Printing Property

After the surface of the light-sensitive material was rubbed in the same manner as described in *3) above, the light-sensitive material was subjected to plate making in the same manner as described in *2) above to form toner images, and the surface of the photoconductive layer was subjected to oil-desensitization treatment by passing twice through an etching processor using ELP-EX. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was determined. The larger the number of the prints, the better the printing property.

As can be seen from the results shown in Table 11, the light-sensitive material according to the present invention provided duplicated image which was clear and free from background fog, even when the ambient condition was fluctuated. On the contrary, with the light-sensitive materials of Comparative Examples 1 and 2, the occurrence of unevenness of density was observed in the highly accurate image portions, in particular, half tone areas of continuous gradation when the ambient condition was fluctuated. As the result of rubbing the surface of photoconductive layer under the weight, the light-sensitive material according to the present invention provided excellent images regardless of the rubbing. However, with the light-sensitive materials of Comparative Examples 1 and 2, the duplicated image could not be employed practically since the scratches occurred in image areas and the occurrence of background stain was observed in non-image areas in the portion which had been rubbed.

Further, each of the materials thus plate-made was subjected to oil-desensitization treatment to prepare an offset printing plate and using the plate printing was conducted. The plate according to the present invention provided 10,000 prints of clear image without background stain. On the contrary, with the plates of Comparative Examples 1 and 2, the scratches of image were observed on prints as they were, and the stain in non-image area was not removed with the oil-desensitization treatment and the background stain occurred from the start of printing.

From all these considerations, it is thus clear that an electrophotographic light-sensitive material which is excellent in anti-abrasion property and image forming performance (in particular, for highly accurate image) and is advantageously employed particularly in a scanning exposure system using a semiconductor laser beam and which provides the extremely good printing characteristics when used as an electrophotographic lithographic printing plate precursor can be obtained only when the binder resin according to the present invention is used.

EXAMPLES 2 AND 3

A mixture of 5 g (solid basis) of Resin ($A_2$-7), (Example 2) or 5 g (solid basis) of Resin ($A_2$-4) (Example 3), 35 g (solid basis) of Resin (B-3), 200 g of photoconductive zinc oxide, 0.020 g of Dye (II) having the structure shown below, 0.20 g of N-hydroxymaleinimide and 300 g of toluene was treated in the same manner as described in Example 1 to prepare an electrophotographic light-sensitive material.

Dye (II)

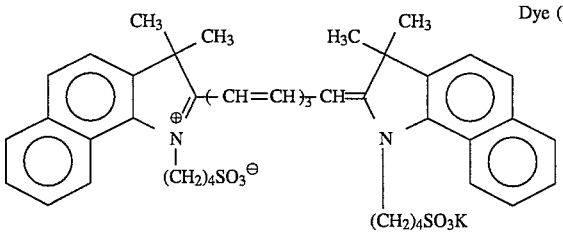

With each of the light-sensitive materials thus-prepared, a film property in terms of surface smoothness, image forming performance and anti-abrasion property were evaluated in the same manner as described in Example 1. Further, printing property was evaluated when it was used as an electrophotographic lithographic printing plate precursor. The results obtained are shown in Table 12 below.

TABLE 12

| | Example 2 | Example 3 |
|---|---|---|
| Smoothness of Photoconductive Layer (sec/cc) *1) | 185 | 175 |
| Image Forming Performance *2) | | |
| I (20° C., 65% RH) | Very good | Good |
| II (30° C., 80% RH) | Very good | Good |
| III (15° C., 30% RH) | Very good | Good |
| Anti-Abrasion Property *3) | Very good | Good |
| Printing Property *4) | 10,000 prints | 10,000 prints |

Each of the properties evaluated in the same manner as described in Example 1 was excellent. Particularly, more improved image forming performance was obtained in Example 2 using the resin (A) having the specific substituent.

EXAMPLES 4 TO 8

Each electrophotographic light-sensitive material was prepared in the same manner as described in Example 1, except for using 6 g of each of Resins (A), 34 g of each of Resin (B) and each of the dyes shown in Table 13 below in place of 6 g of Resin ($A_1$-6), 34 g of Resin (B-2) and Dye (I) used in Example 1.

TABLE 13

| Example | Resin (A) | Resin (B) | Dye | Chemical Structure of Dye |
|---|---|---|---|---|
| 4 | $A_2$-3 | B-6 | (III) | 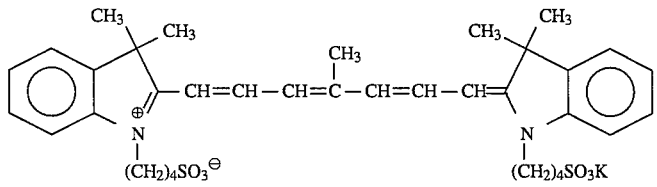 |
| 5 | $A_3$-8 | B-11 | (IV) | 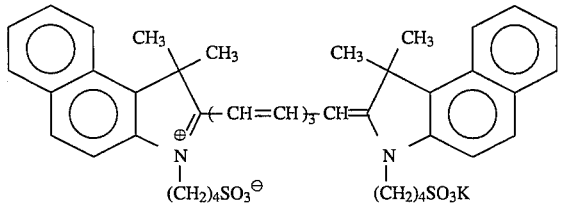 |
| 6 | $A_4$-12 | B-8 | (V) | 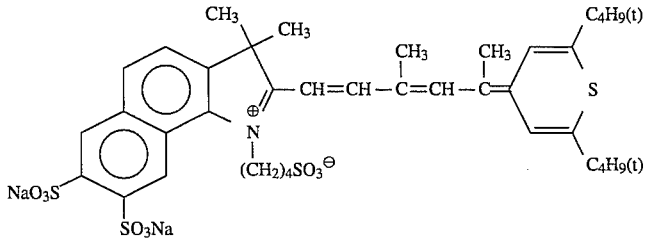 |

TABLE 13-continued

| Example | Resin (A) | Resin (B) | Dye | Chemical Structure of Dye |
|---|---|---|---|---|
| 7 | $A_3$-19 | B-34 | (VI) | 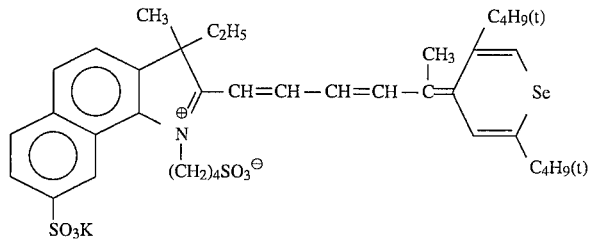 |
| 8 | $A_4$-15 | B-30 | (VII) | 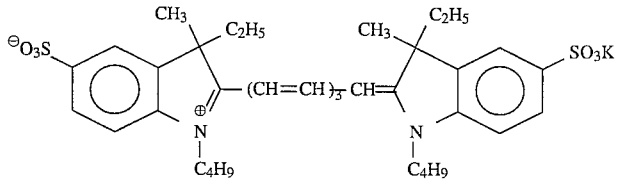 |

Each of the light-sensitive materials according to the present invention provided clear duplicated images free from background fog even when processed under severe conditions of high temperature and high humidity (30° C. and 80% RH) and low temperature and low humidity (15° C. and 30% RH). Further, they exhibited excellent anti-abrasion property and when printing was conducted using them as offset printing plates, 10,000 prints of good quality were obtained.

EXAMPLES 9 TO 28

Each electrophotographic light-sensitive material was prepared in the same manner as described in Example 1, except for using 6 g of each of Resins (A) and 34 g of each of Resins (B) shown in Table 14 below in place of 6 g of Resin ($A_1$-6) and 34 g of Resin (B-2) used in Example 1, respectively.

TABLE 14

| Example | Resin (A) | Resin (B) |
|---|---|---|
| 9 | $A_1$-3 | B-1 |
| 10 | $A_1$-11 | B-4 |
| 11 | $A_1$-9 | B-6 |
| 12 | $A_2$-2 | B-7 |
| 13 | $A_2$-7 | B-8 |
| 14 | $A_2$-8 | B-9 |
| 15 | $A_2$-9 | B-11 |
| 16 | $A_3$-1 | B-12 |
| 17 | $A_3$-5 | B-13 |
| 18 | $A_3$-7 | B-15 |
| 19 | $A_3$-9 | B-17 |
| 20 | $A_3$-14 | B-18 |
| 21 | $A_3$-18 | B-20 |
| 22 | $A_3$-19 | B-21 |
| 23 | $A_3$-22 | B-24 |
| 24 | $A_4$-2 | B-26 |
| 25 | $A_4$-5 | B-27 |
| 26 | $A_4$-6 | B-32 |
| 27 | $A_4$-17 | B-34 |
| 28 | $A_4$-13 | B-35 |

The image forming performance of each of the light-sensitive materials were determined in the same manner as described in Example 1. Each light-sensitive material provided clear duplicated images having good reproducibility of fine lines and letters and no occurrence of unevenness in half tone areas without the formation of background fog. Also, the anti-abrasion property thereof was extremely good.

Further, when these electrophotographic light-sensitive materials were employed as-offset master plate precursors under the same printing condition as described in Example 2, more than 10,000 good prints were obtained respectively.

It can be seen from the results described above that each of the light-sensitive materials according to the present invention was satisfactory in all aspects of the smoothness of the photoconductive layer, image forming performance, film strength and printing property.

EXAMPLE 29

A mixture of 5 g of Resin ($A_3$-5), 35 g of Resin (B-27), 200 g of photoconductive zinc oxide, 0.02 g of uranine, 0.04 g of Rose Bengal, 0.03 g of bromophenol blue, 0.40 g of phthalic anhydride and 300 g of toluene was dispersed by a homogenizer at a rotation of $6\times10^3$ r.p.m. for 6 minutes to prepare a coating composition for a light-sensitive layer. The coating composition was coated on paper, which had been subjected to electrically conductive treatment, by a wire bar at a dry coverage of 25 g/m$^2$, and dried for 20 seconds at 110° C. Then, the coated material was allowed to stand in a dark place for 24 hours under the conditions of 20° C. and 65% RH to prepare an electrophotographic light-sensitive material.

COMPARATIVE EXAMPLE 3

An electrophotographic light-sensitive material was prepared in the same manner as in Example 29, except for using Resin (R-2) described above in place of Resin (B-27) used in Example 29.

With each of the light-sensitive materials thus prepared, the surface smoothness, image forming performance, anti-abrasion property and printing property were evaluated. The results obtained are shown in Table 15 below.

TABLE 15

| | Example 29 | Comparative Example 3 |
|---|---|---|
| Smoothness of Photoconductive Layer (sec/cc) | 180 | 185 |

TABLE 15-continued

| | Example 29 | Comparative Example 3 |
|---|---|---|
| Image Forming *5) Performance | | |
| I (20° C., 65% RH) | good | Edge mark of cutting |
| II (30° C., 80% RH) | good | Edge mark of cutting, unevenness in half tone area |
| III (15° C., 30% RH) | good | Edge mark of cutting, white spots at high image density portion |
| Anti-Abrasion Property *6) | Very good | Severe background stain, severe scratches of image portion |
| Printing Property | 10,000 prints | Poor image of print from the start of printing |

The characteristics were evaluated in the same manner as in Example 1, except that image forming performance and anti-abrasion property were evaluated according to the following procedures.

*5) Image Forming Performance

The electrophotographic light-sensitive material was allowed to stand for one day under the ambient condition described below, the light-sensitive material was subjected to plate making by a full-automatic plate making machine (ELP-404V manufactured by Fuji Photo Film Co., Ltd.) using ELP-T as a toner. The duplicated image thus obtained was visually evaluated for fog and image quality. The ambient condition at the time of image formation was 20° C. and 65% RH (I), 30° C. and 80% RH (II) or 15° C. and 30% RH (III). The original (i.e., block copy) used for the duplication was composed of cuttings of other originals pasted up thereon.

*6) Anti-Abrasion Property

The same procedure as described in *3) hereinbefore was conducted except for using the image forming method described in *5) above in place of that in *3).

From the results, it can be seen that the smoothness of photoconductive layer was good with the light-sensitive materials of the present invention and Comparative Example 3.

With respect to image forming performance, the edge mark of cuttings pasted up was observed as background stain in the non-image areas of the light-sensitive material of Comparative Example 3. Also, the occurrence of unevenness in half tone area of continuous gradation and unevenness of small white spots at high image density portion was observed on the duplicated image when the ambient conditions at the time of the image formation were high temperature and high humidity (II) and low temperature and low humidity (III), respectively. On the contrary, the light-sensitive material according to the present invention provided clear image without background stain.

With respect to the anti-abrasion property, the light-sensitive material according to the present invention was extremely good, although the scratches in image areas and background stain in non-image areas were severely observed in the portion which had been rubbed with Comparative Example 3.

Further, each of these light-sensitive materials was subjected to the oil-desensitization treatment to prepare an offset printing plate and using the plate printing was conducted. The plate according to the present invention provided 10,000 prints of clear image without background stains. However, with the plate of Comparative Example 3, the above described edge mark of cuttings pasted up was not removed with the oil-desensitization treatment and the background stain in non-image areas and scratches in image areas in the rubbed portion occurred from the start of printing.

It can be seen from the results described above that the light-sensitive material according to the present invention is excellent in all aspects of the image forming performance, anti-abrasion property and printing property.

EXAMPLES 30 TO 53

Each electrophotographic light-sensitive material was prepared in the same manner as described in Example 29, except for using 6 g of each of Resin (A) and 34 g of each of Resin (B) shown in Table 16 below in place of 5 g of Resin ($A_3$-5) and 35 g of Resin (B-27) used in Example 29, respectively.

TABLE 16

| Example | Resin (A) | Resin (B) |
|---|---|---|
| 30 | $A_1$-4 | B-22 |
| 31 | $A_1$-8 | B-23 |
| 32 | $A_2$-1 | B-25 |
| 33 | $A_2$-4 | B-26 |
| 34 | $A_3$-2 | B-27 |
| 35 | $A_3$-8 | B-28 |
| 36 | $A_3$-16 | B-29 |
| 37 | $A_3$-17 | B-30 |
| 38 | $A_3$-20 | B-31 |
| 39 | $A_4$-1 | B-33 |
| 40 | $A_4$-1 | B-36 |
| 41 | $A_4$-7 | B-12 |
| 42 | $A_4$-8 | B-13 |
| 43 | $A_4$-9 | B-14 |
| 44 | $A_4$-11 | B-15 |
| 45 | $A_4$-14 | B-16 |
| 46 | $A_4$-16 | B-19 |
| 47 | $A_4$-10 | B-20 |
| 48 | $A_2$-3 | B-21 |
| 49 | $A_4$-4 | B-8 |
| 50 | $A_3$-12 | B-11 |
| 51 | $A_3$-18 | B-4 |
| 52 | $A_3$-20 | B-7 |
| 53 | $A_1$-14 | B-10 |

Each of the light-sensitive materials according to the present invention exhibited the excellent image forming performance, anti-abrasion property and printing property similar to those obtained in Example 29.

POSSIBILITY OF UTILIZATION IN INDUSTRY

In accordance with the present invention, an electrophotographic light-sensitive material which exhibits excellent image reproducibility, moisture resistance and anti-abrasion property and provides clear images of good quality can be obtained. The electrophotographic light-sensitive material according to the present invention is particularly useful in the scanning exposure system using a semiconductor laser beam. The image reproducibility is further improved by using the resin which contains a repeating unit having the specific methacrylate component represented by the general formula (Ia) or (Ib).

What is claimed is:

1. An electrophotographic light-sensitive material having a photoconductive layer containing at least an inorganic photoconductive substance, a spectral sensitizing dye and a binder resin, wherein the binder resin comprises at least one resin (A) shown below and at least one resin (B) shown below:

Resin (A):

a polymer having an acid value of from 5 to 120 and a weight average molecular weight of from $1\times10^3$ to $2\times10^4$ and containing a component represented by the general formula (I) described below in an amount not less than 40 parts by weight per 100 parts by weight of the total polymer component of Resin (A), and a component containing at least one polar group selected from the group consisting of $—PO_3H_2$, —COOH, $—SO_3H$, $—SO_2H$, a phenolic hydroxy group, $—P(=O)(OH)R^1$ (wherein $R^1$ is a hydrocarbon group or $—OR^2$ (wherein $R^2$ represents a hydrocarbon group)) and a cyclic acid anhydride group:

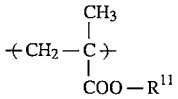

(I)

wherein $R^{11}$ represents a hydrocarbon group;

Resin (B):

an AB or ABA block copolymer having a weight average molecular weight of from $3\times10^4$ to $1\times10^6$ and comprising an A block containing at least a component represented by the general formula (II) described below in an amount of 30 to 100% by weight, the A block being free of a polar group, and a B block containing at least a component corresponding to a monofunctional macromonomer ($M_B$) described below in an amount of 1 to 60% by weight:

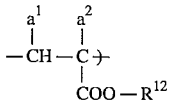

(II)

wherein $a^1$ and $a^2$ each is a hydrogen atom, a halogen atom, a cyano group, a hydrocarbon group, $—COOR^4$ or $—COOR^4$ bonded via a hydrocarbon group (wherein $R^4$ represents a hydrocarbon group); and $R^{12}$ represents a hydrocarbon group;

Monofunctional Macromonomer ($M_B$):

a monofunctional macromonomer having a weight average molecular weight from $1\times10^3$ to $2\times10^4$ and a polymerizable double bond group at only one terminal of the polymer main chain, the monofunctional macromonomer containing a component having at least one polar group selected from the group consisting of $—PO_3H_2$, —COOH, $—SO_3H$, $—P(=O)(OH)R^1$ (wherein $R^1$ has the same meaning as defined above) and a cyclic acid anhydride group, wherein the polar group-containing component contained in Resin (B) is present in an amount of from 0.05 to 10 wt % and the total amount of the polar group-containing component contained in Resin (B) is from 10 to 50% by weight based upon the total polar group-containing component contained in Resin (A).

2. An electrophotographic light-sensitive material as claimed in claim 1, wherein the resin (A) contains, as the component represented by the general formula (I), at least one methacrylate component having an aryl group represented by the following general formulae (Ia) and (Ib):

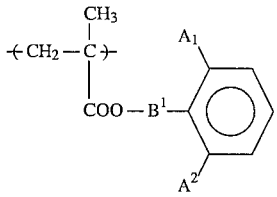

(Ia)

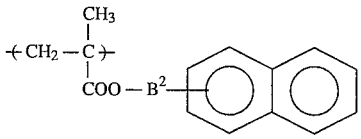

(Ib)

wherein $A^1$ and $A^2$ each is a hydrogen atom, a hydrocarbon group having from 1 to 10 carbon atoms, a halogen atom, a cyano group, $—COZ^2$ or $—COOZ^2$, wherein $Z^2$ represents a hydrocarbon group having from 1 to 10 carbon atoms; and $B^1$ and $B^2$ each is a mere bond or a linking group containing from 1 to 4 linking atoms, which connects —COO— and the benzene ring.

3. An electrophotographic light-sensitive material as claimed in claim 1, wherein the resin (A) is a homo or random polymer containing the component of the general formula (I) and having the polar group-containing component in the polymer chain and/or at one terminal of the polymer main chain.

4. An electrophotographic light-sensitive material as claimed in claim 1, wherein the resin (A) is an AB block polymer comprising an A block containing the component of the general formula (I) and a B block containing the polar group-containing component.

5. An electrophotographic light-sensitive material as claimed in claim 1, wherein the resin (A) is a graft polymer comprising the component of the general formula (I) and a component corresponding to a mono-functional macromonomer having a weight average molecular weight of from $1\times10^3$ to $2\times10^4$ and a polymerizable double bond group at one terminal of the polymer chain and having the polar group-containing component in the polymer chain of the macromonomer and/or at one terminal of the polymer main chain of the graft polymer.

6. An electrophotographic light-sensitive material as claimed in claim 1, wherein the resin (A) is a starlike polymer comprising an organic molecule having bonded thereto at least three polymer chains each containing the component of the general formula (I) and the polar group-containing component.

* * * * *